US010764707B1

(12) United States Patent
Porter et al.

(10) Patent No.: US 10,764,707 B1
(45) Date of Patent: Sep. 1, 2020

(54) SYSTEMS, METHODS, AND DEVICES FOR PRODUCING EVANESCENT AUDIO WAVES

(71) Applicant: Facebook Technologies, LLC, Menlo Park, CA (US)

(72) Inventors: Scott Phillips Porter, Redwood City, CA (US); Jacob Ryan Donley, Kirkland, WA (US); Ashley Saulsbury, Los Gatos, CA (US); Antonio John Miller, Woodinville, WA (US)

(73) Assignee: Facebook Technologies, LLC, Menlo Park, CA (US)

( * ) Notice: Subject to any disclaimer, the term of this patent is extended or adjusted under 35 U.S.C. 154(b) by 0 days.

(21) Appl. No.: 16/261,261

(22) Filed: Jan. 29, 2019

(51) Int. Cl.

| | |
|---|---|
| ***H04S 7/00*** | (2006.01) |
| ***H04R 5/00*** | (2006.01) |
| ***H04R 3/00*** | (2006.01) |
| ***H04R 5/033*** | (2006.01) |
| ***H04R 5/04*** | (2006.01) |
| ***H04S 3/00*** | (2006.01) |
| ***H04R 5/02*** | (2006.01) |

(52) U.S. Cl.
CPC ..... *H04S 7/304* (2013.01); *H04R 5/02* (2013.01); *H04R 5/033* (2013.01); *H04R 5/04* (2013.01); *H04S 3/008* (2013.01); *H04S 2400/01* (2013.01)

(58) Field of Classification Search
CPC ... H04S 7/00; H04S 7/30; H04S 7/303; H04S 7/304; H04S 7/306; H04S 7/40; H04S 3/008; H04S 2400/01; H04S 2400/11; H04R 3/00; H04R 3/12; H04R 5/00; H04R 5/02; H04R 5/04; H04R 5/033; H04R 1/10; H04R 1/1083
See application file for complete search history.

(56) References Cited

U.S. PATENT DOCUMENTS

| | | | | |
|---|---|---|---|---|
| 2006/0215853 | A1* | 9/2006 | Hiruma | H04S 7/30 381/97 |
| 2019/0191241 | A1* | 6/2019 | Maeno | H04R 1/403 |
| 2019/0238982 | A1* | 8/2019 | Maeno | H04R 3/12 |
| 2019/0327573 | A1* | 10/2019 | Maeno | H04R 1/403 |

FOREIGN PATENT DOCUMENTS

| | | | |
|---|---|---|---|
| JP | 2012044572 | A * | 3/2012 |
| JP | 2013236216 | A * | 11/2013 |

* cited by examiner

*Primary Examiner* — Thang V Tran
(74) *Attorney, Agent, or Firm* — FisherBroyles, LLP

(57) ABSTRACT

A system may include at least one audio transducer and a controller. The controller may generate at least one actuation signal. The at least one actuation signal may drive the at least one audio transducer such that the at least one audio transducer generates evanescent wave audio signals in proximity to a wearer's ear. The evanescent wave audio signals may decay in strength with distance from the at least one audio transducer. Various other apparatuses, systems, and methods are also disclosed.

20 Claims, 13 Drawing Sheets

SYSTEMS, METHODS, AND DEVICES FOR PRODUCING EVANESCENT AUDIO WAVES

BACKGROUND

Wearing a personal audio reproduction headset for listening to audio content may result in a pleasurable experience for the wearer. The audio reproduction headset may be integrated in a virtual-reality or augmented-reality head-mounted display system and may produce an immersive experience. Head-mounted display systems with an integrated audio reproduction device may enable users to travel through space and time, interact with friends in a three-dimensional world, or play video games in a radically redefined way. Head-mounted display systems with an integrated audio reproduction device may also be used for purposes other than recreation, governments may use them for military training simulations, doctors may use them to practice surgery, and engineers may use them as visualization and audio aids.

In any use of a virtual-reality or augmented-reality system with integrated audio reproduction, making the experience as functional and comfortable as possible for the wearer and others near the wearer may be critical. However, many design features of head-mounted display systems with integrated audio reproduction may potentially interfere with a comfortable experience for the wearer and others near the wearer. For example, the audio reproduction device may produce a comfortable audio reproduction experience for the wearer, but the reproduced audio may travel away from the wearer and provide discomfort to others near the wearer. Further, the reproduced audio traveling to unintended listeners near the wearer may pose a privacy threat to the wearer, making the experience less compelling.

SUMMARY

As will be described in greater detail below, the instant disclosure describes a variety of systems, methods, and devices for creating evanescent audio waves in an audio reproduction headset. For example, a headset may include at least one audio transducer and a controller coupled to the audio transducer. The controller may generate at least one actuation signal that drives the at least one audio transducer such that the audio transducer generates evanescent wave audio signals in proximity to a wearer's ear. The evanescent wave audio signals may decay in strength with distance from the at least one audio transducer.

The at least one audio transducer may be configured in a variety of ways. For example, the at least one audio transducer may include a dipole speaker enclosed in a manner that generates the evanescent wave audio signals in proximity to a wearer's ear. In another example, at least two audio transducers may be configured to be out of phase relative to each other in a manner that generates evanescent waves.

In one example, a system may include at least one audio transducer and a controller. In some examples, the controller may generate at least one actuation signal. In some examples, the at least one actuation signal may drive the at least one audio transducer such that the at least one audio transducer generates evanescent wave audio signals in proximity to a wearer's ear. In some examples, the evanescent wave audio signals may decay in strength with distance from the at least one audio transducer.

In some examples, the at least one audio transducer may comprise a dipole speaker and a geometry of an enclosure substantially surrounding the dipole speaker may generate the evanescent wave audio signals in proximity to a wearer's ear.

In some examples, the system may further include at least two audio transducers and a plurality of actuation signals. In some examples, each of the plurality of actuation signals may be substantially out of phase in relation to other actuation signals of the plurality of actuation signals.

In some examples, each of the plurality of actuation signals may be out of phase in relation to other actuation signals of the plurality of actuation signals by less than 180 degrees.

In some examples, the controller may generate a plurality of second actuation signals configured to drive the at least two audio transducers substantially in phase in relation to each other to generate propagating wave audio signals and generation of the plurality of actuation signals or generation of the plurality of second actuation signals is based on a trigger.

In some examples, the trigger may comprise a signal to noise ratio (SNR) such that the plurality of actuation signals drive the at least two audio transducers when the SNR is below a threshold amount and the plurality of second actuation signals drive the at least two audio transducers when the SNR is equal to or above the threshold amount.

In some examples, the system may further include a switch configured to switch between generation of the evanescent wave audio signals and the propagating wave audio signals.

In some examples, the switch may switch between generation of the evanescent wave audio signals and the propagating wave audio signals by reversing the polarity of either the plurality of actuation signals or the plurality of second actuation signals.

In some examples, the controller may be configured to beamform the output of the at least one audio transducer in a specified direction.

In some examples, the system may include a linear array of four or more audio transducers. In some examples, a subset of the four or more audio transducers within the linear array may be driven by the plurality of actuation signals, and a different subset of the four or more audio transducers within the linear array may be driven by a plurality of second actuation signals.

In some examples, the system may further include a linear array of audio sources and generation of the evanescent wave audio signals in proximity to the wearer's ear may be based on at least a spacing distance between the audio sources.

In some examples, the audio sources may comprise at least one of the at least one audio transducer or openings in an enclosure substantially surrounding the at least one audio transducer.

In one example, a device may include at least one audio transducer and a controller. In some examples, the controller may generate at least one actuation signal. In some examples, the at least one actuation signal may drive the at least one audio transducer such that the at least one audio transducer generates evanescent wave audio signals in proximity to a wearer's ear. In some examples, the evanescent wave audio signals may decay in strength with distance from the at least one audio transducer.

In some examples, the at least one audio transducer may comprise a dipole speaker. In some examples, a geometry of an enclosure substantially surrounding the dipole speaker may generate the evanescent wave audio signals in proximity to a wearer's ear.

In some examples, the device may further include at least two audio transducers and a plurality of actuation signals. In some examples, each of the plurality of actuation signals may be substantially out of phase in relation to other actuation signals of the plurality of actuation signals.

In some examples, each of the plurality of actuation signals may be out of phase in relation to other actuation signals of the plurality of actuation signals by less than 180 degrees.

In some examples, the controller may generate a plurality of second actuation signals configured to drive the at least two audio transducers substantially in phase in relation to each other to generate propagating wave audio signals. In some examples, generation of the plurality of actuation signals or generation of the plurality of second actuation signals may be based on a trigger.

In some examples, the trigger may comprise a signal to noise ratio (SNR), such that the plurality of actuation signals drive the at least two audio transducers when the SNR is below a threshold amount. In some examples, the plurality of second actuation signals may drive the at least two audio transducers when the SNR is equal to or above the threshold amount.

In some examples, the device may further include a switch configured to switch between generation of the evanescent wave audio signals and the propagating wave audio signals.

In some examples, the switch may switch between generation of the evanescent wave audio signals and the propagating wave audio signals by reversing the polarity of either the plurality of actuation signals or the plurality of second actuation signals.

In some examples, the controller may be configured to beamform the output of the at least one audio transducer in a specified direction.

In one example, a method may include coupling at least one audio transducer to a wearable device. In some examples, the method may further include connecting the at least one audio transducer to a controller. In some examples, the controller may generate at least one actuation signal. In some examples, the at least one actuation signal may drive the at least one audio transducer such that the at least one audio transducer generates evanescent wave audio signals in proximity to a wearer's ear. In some examples, the evanescent wave audio signals may decay in strength with distance from the at least one audio transducer.

Features from any of the above-mentioned embodiments may be used in combination with one another in accordance with the general principles described herein These and other embodiments, features, and advantages will be more fully understood upon reading the following detailed description in conjunction with the accompanying drawings and claims.

BRIEF DESCRIPTION OF THE DRAWINGS

The accompanying drawings illustrate a number of exemplary embodiments and are a part of the specification. Together with the following description, these drawings demonstrate and explain various principles of the instant disclosure.

Figure 1:
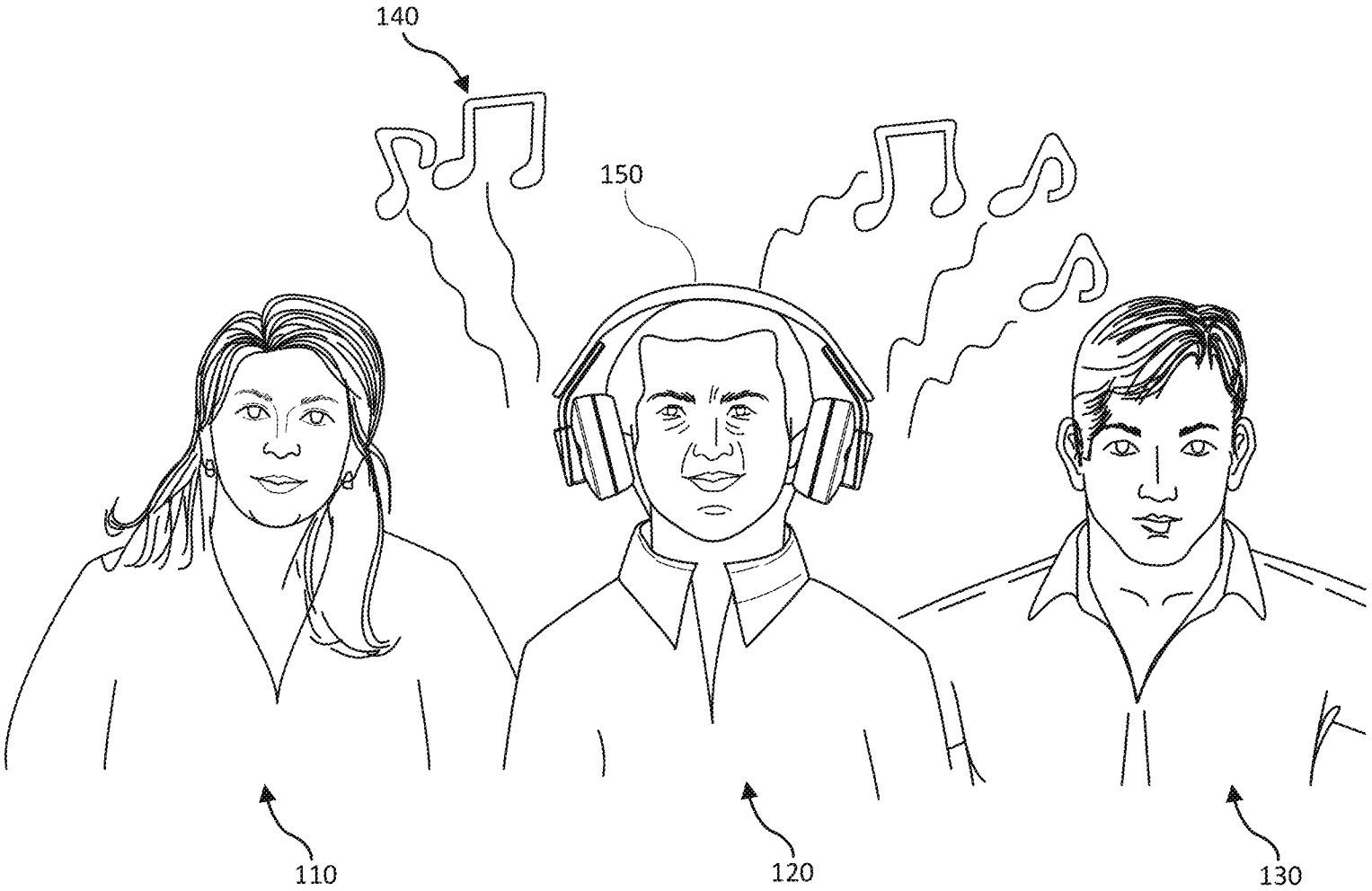
FIG. 1 illustrates an audio reproduction headset producing propagating audio waves.

Throughout the drawings, identical reference characters and descriptions indicate similar, but not necessarily identical, elements. While the exemplary embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION OF EXEMPLARY EMBODIMENTS

As will be described in greater detail below, the instant disclosure describes a variety of systems, methods, and devices for creating evanescent audio waves in an audio reproduction headset. An evanescent wave headset may include any device or system that produces near-field sound waves with energy that may be concentrated in proximity of a wearer's ears and that may decay significantly as a function of distance from the headset. In this manner, the systems and methods described herein may enable the wearer to privately consume audio content at an acceptable sound volume level while avoiding annoyance to others nearby who may not wish to hear the audio content.

The systems and methods described herein may leverage the characteristics of evanescent waves in unexpected and/or beneficial ways. In some traditional audio systems, evanescent sound waves may be considered undesirable and system designers may attempt to create systems that do not suffer from potentially undesirable effects of evanescent fields. In contrast, the ear-adjacent headsets of this disclosure may be designed to intentionally create evanescent waves to create a desirable effect (e.g., to reduce audio bleed from a headset). These headsets may create evanescent sound waves that, instead of propagating towards others who may be around a wearer, exhibit an energy field that may decay exponentially toward these other potential listeners. As a result, the systems described herein may provide greater privacy for a user, less disturbance for others around the user, and/or a variety of other features and advantages.

Figure 2A:
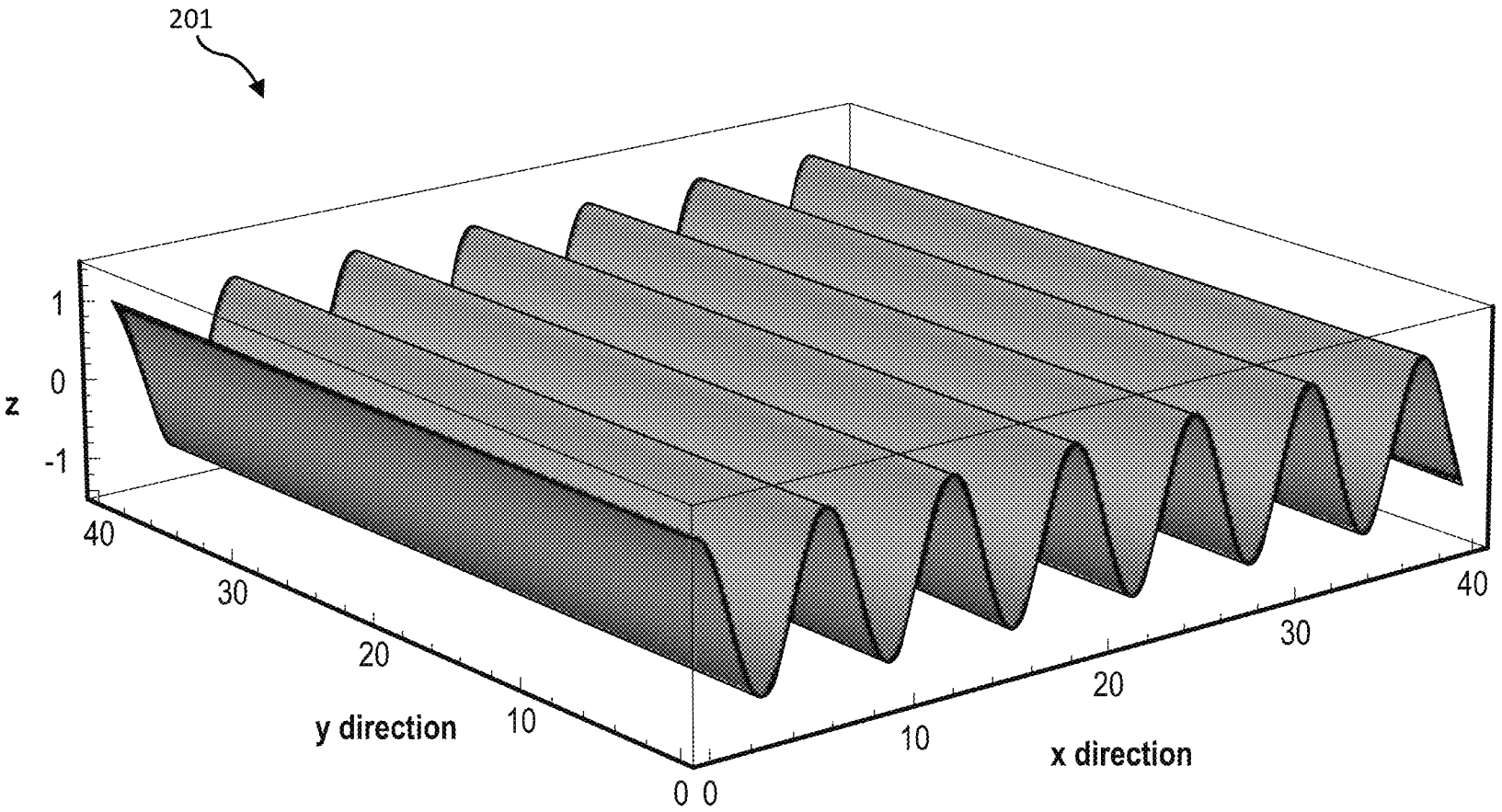
FIG. 2A illustrates a graph of a propagating audio wave.
Figure 2B:
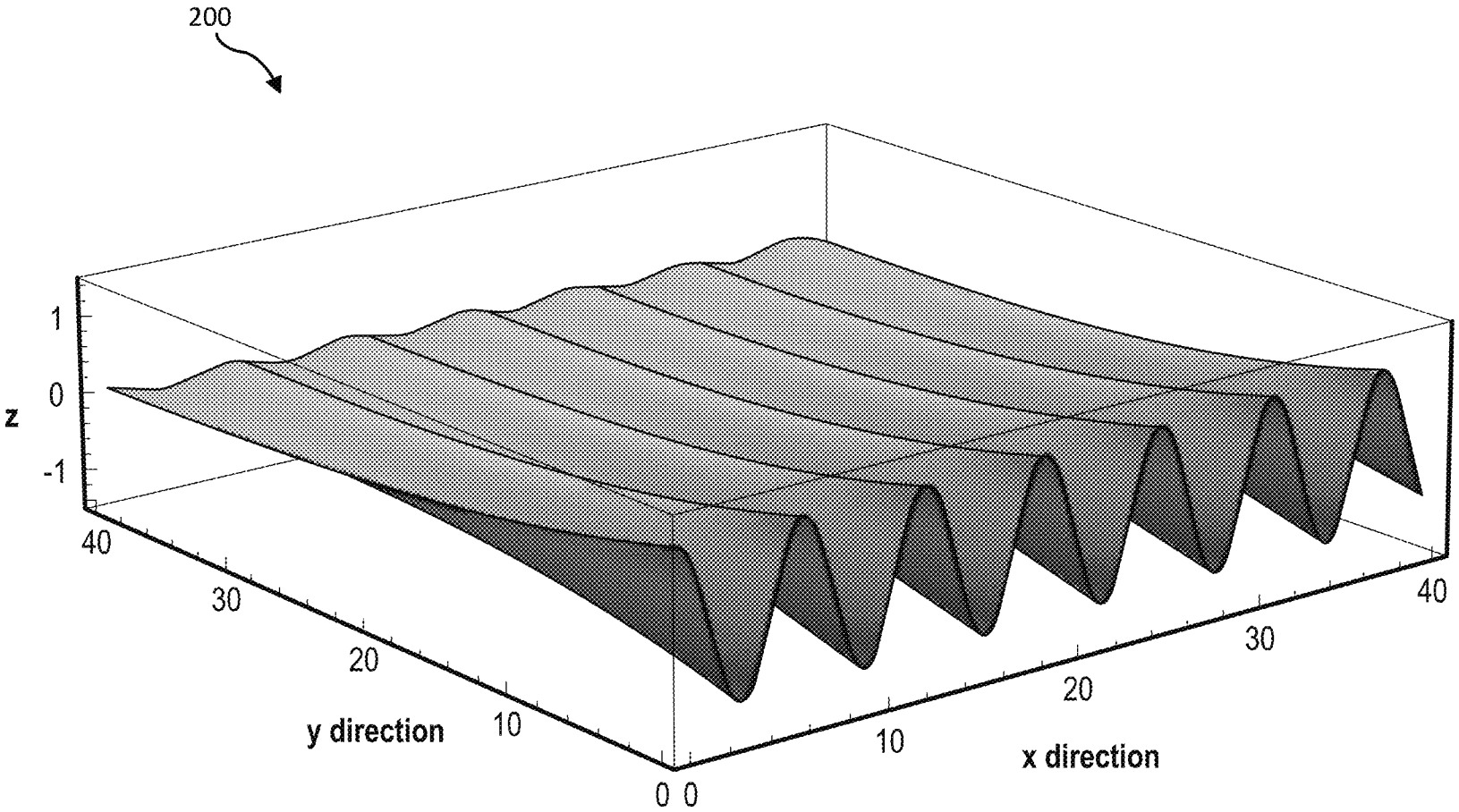
FIG. 2B illustrates a graph of an evanescent audio wave.

The following description will provide, with reference to FIGS. 1, 2A, and 2B, a comparison of propagating audio waves of some traditional systems and evanescent audio waves of the systems presented herein. The discussion corresponding to FIGS. 3 and 4 will provide an overview of exemplary ear-adjacent evanescent array systems, the discussion corresponding to FIG. 5 describes how audio waves behave in such systems, and the discussion corresponding to FIG. 8 describes a method for creating such systems. The following will also provide, with reference to FIGS. 6, 7, and 9-11, detailed descriptions of exemplary systems in which evanescent audio arrays may be implemented.

FIG. 1 illustrates an audio reproduction headset that may produce audio waves that propagate away from wearer 120. As shown in FIG. 1, wearer 120 may wear an audio reproduction device 150 adjacent to and/or in proximity to the ears of wearer 120. In this example, audio signals 140 from audio reproduction device 150 may be heard by wearer 120 but may also be heard by nearby listeners 110 and 130 due to leakage from audio reproduction device 150. This type of audio leakage may be particularly problematic in open-back headphones or other listening devices (e.g., audio transducers in an augmented-reality headset) that allow users to hear ambient audio in their environment. Audio leakage may be a privacy concern for wearer 120 and/or may be an annoyance to nearby listeners 110 and 130.

As noted, the problematic audio leakage illustrated in FIG. 1 may be a result of audio waves 140 propagating away from wearer 120. FIG. 2A illustrates a graph 201 of a propagating audio wave that travels as a series of compressions and rarefactions of air. The intensity of a propagating audio wave may decay according to the inverse square law in each direction of propagation. As shown in graph 201 of FIG. 2A, an audio wave may oscillate between a positive and negative value as shown on the Z-scale. A higher value on the Z-scale may indicate the amplitude of the sound pressure level (e.g., loudness) associated with the audio wave. As the audio wave propagates in the x direction, the amplitude of the sound pressure level may decay with distance. As the audio wave propagates in the x direction, the amplitude of the sound pressure level may decay with distance geometrically according to an inverse square law. As the audio wave propagates in the y direction, the amplitude of the sound pressure level may also decay geometrically according to an inverse square law, where x and y are the distances from the source of the audio wave and the direction of y is orthogonal to the direction of x. While FIG. 2A shows propagation in two dimensions for purposes of illustration, traditional acoustic radiators may create waves that propagate in three dimensions and that, as a result, may create problematic leakage in three dimensions.

As noted, properties of evanescent waves may be used to control the leakage that results from propagating waves. FIG. 2B illustrates a graph 200 of an evanescent audio wave that decays faster than a propagating audio wave in the y direction. As shown in FIG. 2B, an audio wave may oscillate between a positive and negative value as shown on the Z-scale. In this example, the peaks and valleys in the x direction may represent sound being emitted from a set of transducers with each transducer being 180 degrees out of phase with each other. In the y direction, the amplitude of the signal may decay significantly (e.g., exponentially). An audio reproduction device that produces audio waves that decay exponentially in one direction may provide the benefits of reproducing audio content for a wearer of the audio reproduction device at an acceptable sound level for listening to the audio content without creating significant leakage audible to others nearby.

Figure 3:
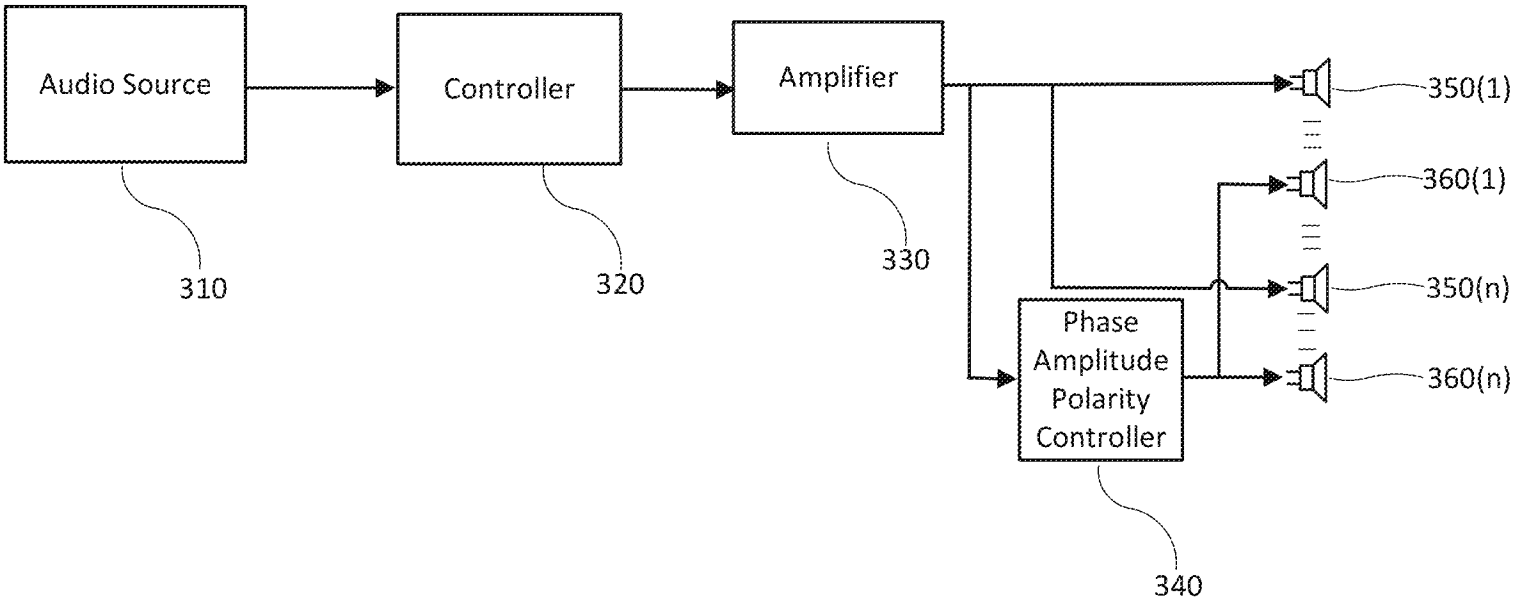
FIG. 3 illustrates a block diagram of a control system for audio reproduction.
Figure 4A:
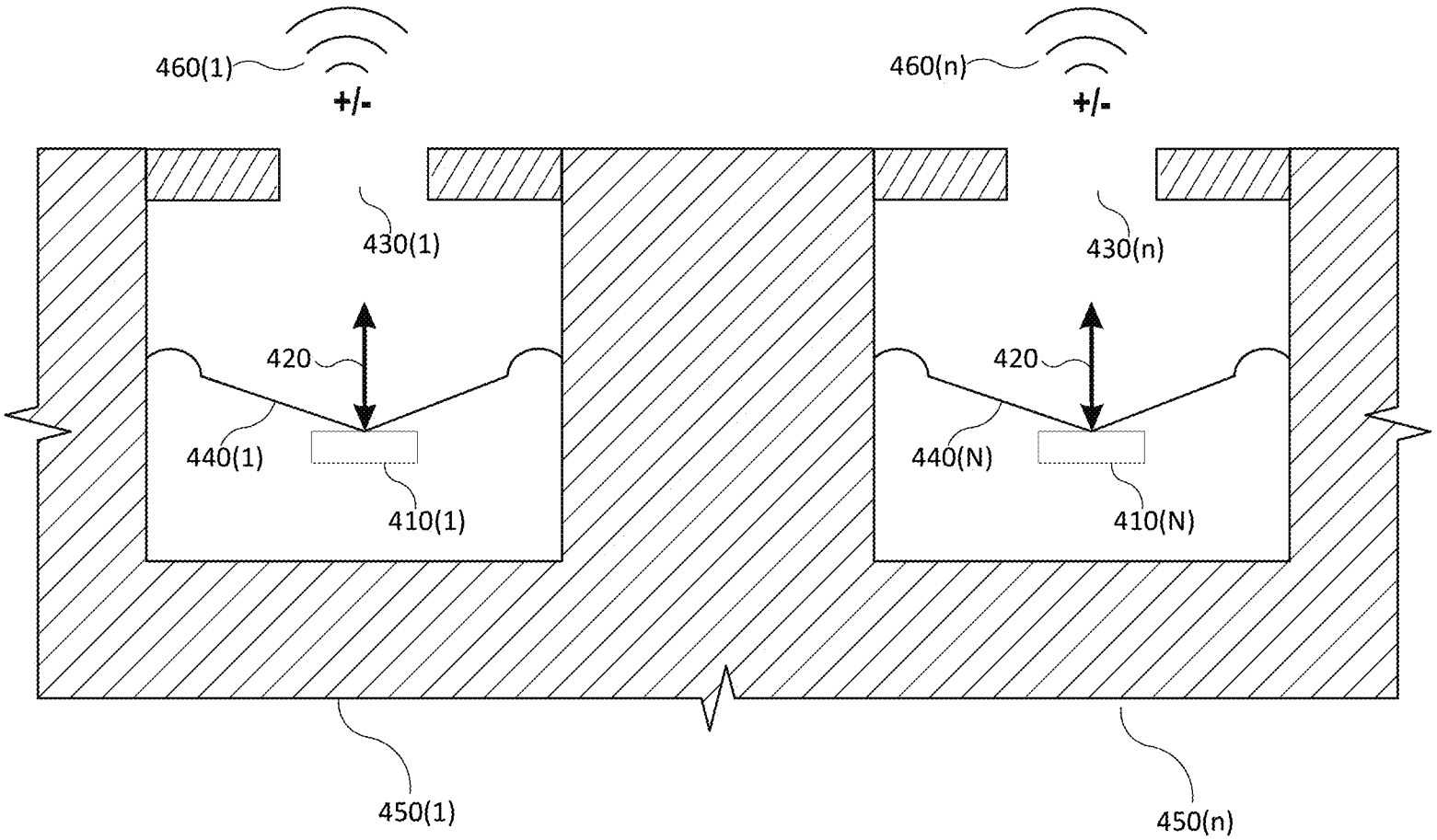
FIG. 4A illustrates an example of a cross section of an array of audio transducers.
Figure 4B:
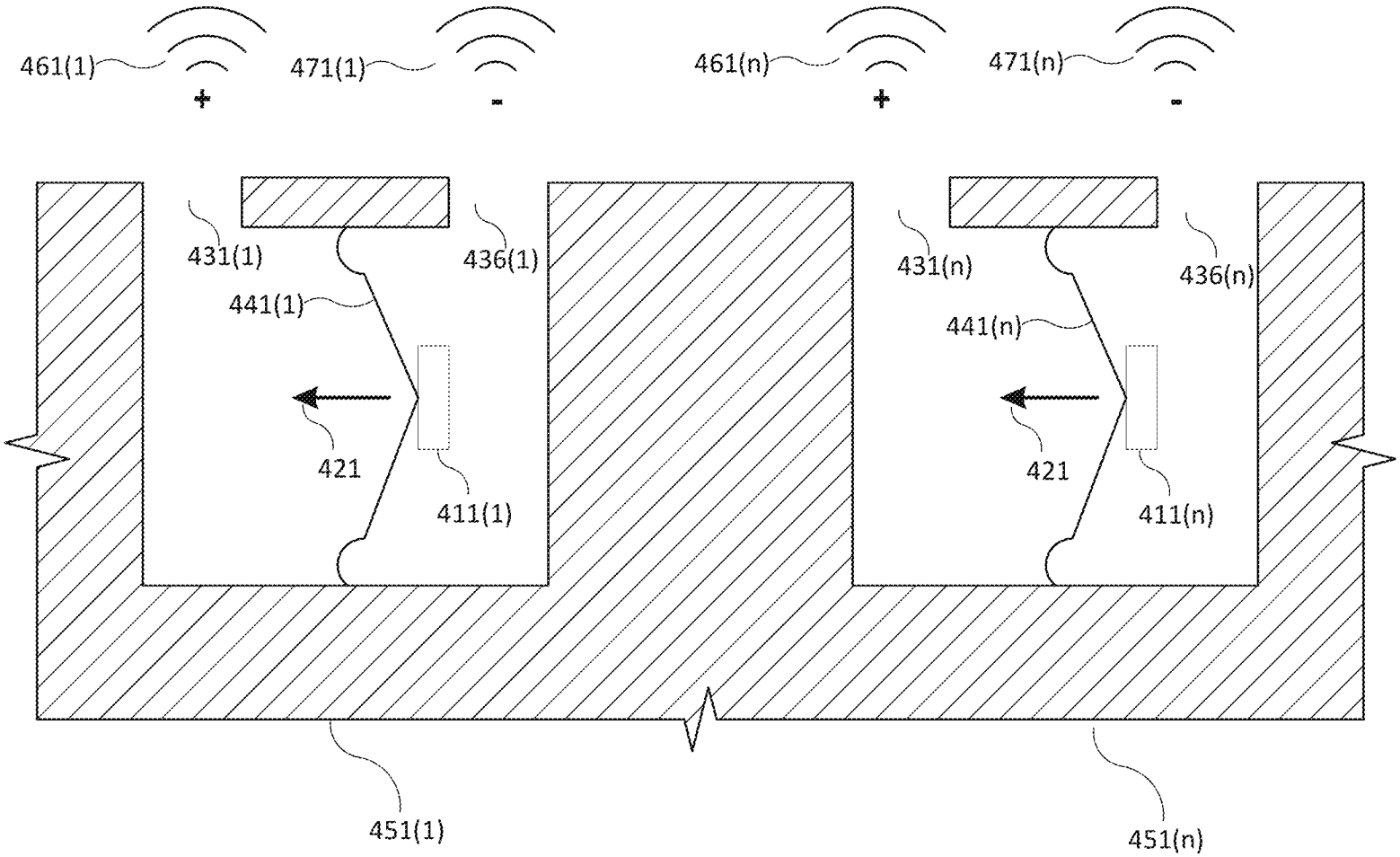
FIG. 4B illustrates another example of a cross section of an array of audio transducers.

An audio may system be designed to create evanescent audio waves in a variety of ways. In some examples, evanescent audio waves may be created by using a set of two or more transducers and alternating the phase about 180 degrees for every other transducer, as shown in FIG. 3. In other examples, evanescent audio waves may be created by an audio system configured with a set of one or more monopole speakers, as shown in FIG. 4A and/or one or more dipole speakers, as shown in FIG. 4B.

FIG. 3 illustrates a block diagram of a control system for audio reproduction. In some examples, a control system for audio reproduction may produce sound waves that decay at different rates depending on the direction of the sound wave. In some examples, the sound wave may decrease exponentially in at least one direction towards others nearby.

As shown in FIG. 3, audio source 310 may provide an electrical audio signal to controller 320. Audio source 310 may provide any suitable type of content including, without limitation, audio content in the frequency range of human hearing. The audio content may include, without limitation, music content, gaming content, speech content, or a combination thereof. In some examples, the audio content may be retrieved from, without limitation, a memory storage device, a server, the Internet, a communication port, a microphone, or a combination thereof. The audio source may be analog and/or digital. The audio source may be encoded using any suitable encoding method including, without limitation, AAC, AMR, MP3, PCM, WAV, AIFF, MPEG, etc. Controller 320 may decode the encoded audio source, convert the decoded digital audio signal to an analog audio signal, and provide the analog audio signal to amplifier 330. In some examples, amplifier 330 may control the amplitude of the analog audio signal and drive audio transducers 350(1) to 350(*n*). Amplifier 330 may control the amplitude of the analog audio signal using any type of amplifier that may vary the amplitude of the analog audio signal.

Phase, amplitude, and polarity controller (PAPC) 340 may phase shift the analog audio signal output from amplifier 330. PAPC 340 may vary the phase of the analog audio signal using any type of phase shifting method, including, without limitation, active filtering, passive filtering, delay line, or a combination thereof. In some examples, PAPC 340 may receive the audio signal in digital form and PAPC 340 may shift the phase in the digital domain. PAPC 340 may shift the phase in the digital domain using, without limitation, a digital signal processor, a microprocessor, or a combination thereof. The phase-shifted analog audio signal from PAPC 340 may drive audio transducers 360(1) to 360(*n*). PAPC 340 may include an amplifier and control the amplitude of signals driving audio transducers 360(1) to 360(*n*).

In some examples, PAPC 340 may provide analog audio signals with a phase shift. PAPC 340 may provide any phase shift that enables the production of evanescent sound waves. In some examples, PAPC 340 may provide a phase shift in the range of 0 degrees to 360 degrees relative to the phase of the signals driving audio transducers 350(1) to 350(*n*). PAPC 340 may provide analog audio signals with a phase shift of about 180 degrees to drive audio transducers 360(1) to 360(*n*). PAPC 340 may provide analog audio signals with a phase shift in the range of about 160 degrees to 170 degrees, about 170 degrees to 180 degrees, about 180 degrees to 190 degrees, and/or about 190 degrees to 200 degrees to drive audio transducers 360(1) to 360(*n*). PAPC 340 may provide analog audio signals with a phase shift that maximizes the exponential decrease in the sound wave as it travels in at least one direction towards others nearby. In some examples, PAPC 340 may provide analog audio signals with a phase shift of about 179 degrees to maximize the exponential decrease in the sound wave as it travels in at least one direction.

PAPC 340 may switch the polarity of the analog audio signal output from amplifier 330. PAPC 340 may switch the polarity of the analog audio signal in a binary fashion having two states (e.g., switching from a positive signal to a negative signal or switching from a negative signal to a positive signal). PAPC 340 may switch the polarity of the analog audio signal using any type of polarity switching method, including, without limitation, diode switching, field effect transistor switching, active filtering, passive filtering, or a combination thereof. In some examples, PAPC 340 may receive the audio signal in digital form and PAPC 340 may switch the polarity in the digital domain. PAPC 340 may switch the polarity in the digital domain using, without limitation, a digital signal processor, a microprocessor, or a combination thereof. The polarity switched analog audio signal from PAPC 340 may drive audio transducers 360(1) to 360(*n*).

In some examples, PAPC 340 may also include an amplifier. The amplifier may be the same or different from amplifier 330. The amplifier may operate in conjunction with the polarity switch to create a polarity switched analog audio signal that operates in a non-binary fashion. The amplifier may continuously vary the amplitude of the polarity switched analog audio signal. In some examples, PAPC 340 may continuously or discretely vary any or all of the parameters associated with the phase, amplitude and/or polarity of the analog audio signal. By varying the phase amplitude and/or polarity of the analog audio signal driving audio transducers 360(1) to 360(*n*) a variation in decay rates may be created in the sound levels that propagate in multiple directions away from the wearer. Varying the sound levels that propagate in multiple directions may enable control over levels of loudness and evanescence.

Although FIG. 3 shows multiple audio transducers being driven, the present disclosure is not limited to such, and a single audio transducer may be driven to create a combination of propagating audio waves and evanescent audio waves. In some examples, audio transducers 350(1) to 350(*n*) may be disposed in proximity to audio transducers 360(1) to 360(*n*), respectively such that when a phase shifted audio signal is provided to audio transducers 360(1) to 360(*n*), the resulting sound waves may experience a destructive interference between adjacent audio transducers which may cause the sound waves to decrease exponentially in at least one direction (e.g., the destructive interference may produce an evanescent sound wave). In some examples, audio transducers 350(1) to 350(*n*) may be disposed in proximity to audio transducers 360(1) to 360(*n*) in an interleaved fashion. For example, the audio transducers may be disposed in an interleaved fashion in the following order: audio transducer 350(1) is disposed next to audio transducer 360(1), audio transducer 360(1) is disposed next to audio transducer 350(*n*), and audio transducer 350(*n*) is disposed next to audio transducer 360(*n*). When audio transducer 350(1) is disposed in close proximity to audio transducer 360(1) and audio transducer 360(1) is driven with an audio signal that is out of phase with respect to the audio signal driving audio transducer 350(1), audio transducers 350(1) and 360(1) may in combination produce audible sound pressure waves. The audible sound pressure waves produced by the combination of audio transducers 350(1) and 360(1) using an out-of-phase audio signal to drive audio transducer 360(1) may travel away from audio transducers 350(1) and 360(1) with varying degrees of decay depending on the direction of travel. In some examples, the audible sound pressure waves may decay exponentially with distance (e.g. evanescent wave) in one direction and decay according to an inverse square law with distance in another direction.

In some examples, PAPC 340 may introduce a zero-degree phase shift (e.g. no phase shift) to the audio signals driving audio transducers 360(1) to 360(*n*). In this case, audio transducers 360(1) to 360(*n*) may be driven by signals of the same phase (e.g. in-phase) as audio transducers 350(1) to 350(*n*). Driving audio transducers 350(1) to 350(*n*) and 360(1) to 360(*n*) with in-phase audio signals may produce sound pressure levels decreasing at similar rates in all directions away from audio transducers 350(1) to 350(*n*) and 360(1) to 360(*n*).

In some examples, PAPC 340 may switch between not introducing a phase shift into the audio signals driving audio transducers 360(1) to 360(*n*) and introducing a phase shift into the audio signals driving audio transducers 360(1) to 360(*n*). Switching between introducing a phase shift and not introducing a phase shift into the audio signals driving audio transducers 360(1) to 360(*n*) may be triggered by any of a variety of events. For example, switching between introducing a phase shift and not introducing a phase shift may be triggered by one or more events including, without limitation, a wearer interface event, a signal-to-noise ratio (SNR), an ambient audio level, or a combination thereof. Switching between introducing a phase shift and not introducing a phase shift may result in a change in the sound pressure levels in the area surrounding audio transducers 350(1) to 350(*n*) and 360(1) to 360(*n*). A wearer interface event controlling the switching between introducing a phase shift and not introducing a phase shift may include, without limitation, receiving a wearer voice command, a wearer keypad/touchpad entry, a wearer pushbutton entry, or a combination thereof. In some examples, an SNR threshold may control a phase shift introduction. One or more systems described herein may calculate the SNR by comparing signal levels. In some examples, these systems may calculate the SNR by comparing a signal level driving audio transducers 350(1) to 350(*n*) and/or 360(1) to 360(*n*) to a level of noise measured (e.g., by a microphone) within an environment surrounding audio transducers 350(1) to 350(*n*) and 360(1) to 360(*n*). In some examples, when the SNR is below a threshold, PAPC 340 may not introduce a phase shift to the audio signals driving audio transducers 360(1) to 360(*n*) thereby eliminating the evanescent audio wave and increasing the sound pressure level emitted from audio transducers 350(1) to 350(*n*) and 360(1) to 360(*n*). When an event is triggered causing the elimination of the evanescent audio wave, audio transducers 360(1) to 360(*n*) may be driven by amplifier 330 without the introduction of the phase shift resulting in audio transducers 350(1) to 350(*n*) and 360(1) to 360(*n*) being driven in phase. Driving audio transducers 350(1) to 350(*n*) and 360(1) to 360(*n*) in phase may result in a producing a sound wave that propagates in multiple directions away from the wearer at a similar rate of decay.

FIG. 4A illustrates a cross section of an array of audio transducers that may, according to embodiments described herein, produce evanescent audio waves. Audio transducers 450(1) to 450(*n*) may include any type of transducer that converts electrical signals to air pressure waves. In some examples, audio transducers 450(1) to 450(*n*) may be monopole speakers. In some examples, audio transducers 450(1) to 450(*n*) may include actuators 410(1) to 410(*n*). Actuators 410(1) to 410(*n*) may drive cones 440(1) to 440(*n*) respectively such that cones 440(1) to 440(*n*) create positive and negative air pressure wave in direction 420. The positive and negative air pressures waves created by cones 440(1) to

440(*n*) may create audible sound waves 460(1) to 460(*n*) that propagate away from audio transducers 450(1) to 450(*n*) respectively.

In some examples, audible sound waves 460(1) to 460(*n*) may propagate away from audio transducers 450(1) to 450(*n*) in multiple directions such that the amplitude of the audible sound decreases with distance in substantially the same amount in each of the multiple directions.

In some examples, audible sound waves 460(1) to 460(*n*) may travel away from audio transducers 450(1) to 450(*n*) in multiple directions such that the audible sound waves decrease with distance according to an inverse square law in one direction and decrease exponentially with distance in a different direction. The direction in which the audible sound waves decrease exponentially with distance may be an evanescent sound wave and travel orthogonally to the direction in which the audible sound waves decrease according to an inverse square law.

In some examples, audio transducer 450(1) may produce an evanescent sound wave due to a cancellation and/or interference effect between sound waves 460(1) and 460(*n*). The cancellation and/or interference effect may result from the geometry of an enclosure surrounding actuators 410(1) to 410(*n*) and cones 440(1) to 440(*n*) and/or the geometry of gaps 430(1) to 430(*n*). In some examples, an evanescent sound wave due to a cancellation and/or interference effect may result from a spacing distance between adjacent audio transducers.

As described above with respect to FIG. 3, switching between producing an evanescent audio wave and not producing an evanescent audio wave may be triggered by various events including, without limitation, a wearer interface event, a signal to noise ratio (SNR), an ambient audio level, or a combination thereof. In some examples, the switching may result from changing the geometry of an enclosure surrounding actuator 410(1) and cone 440(1). Changing the geometry of an enclosure surrounding actuator 410(1) and cone 440(1) may change the cancellation and/or interference effects between sound wave 460(1) and sound wave 460(*n*) thereby switching between producing an evanescent audio wave and not producing an evanescent audio wave. In some examples, changing the geometry of gap 430(1) through which the sound pressure wave produced by actuator 410(1) and cone 440(1) passes may change the cancellation and/or interference effects between sound wave 460(1) and sound wave 460(*n*) thereby switching between producing an evanescent audio wave and not producing an evanescent audio wave. Changing the geometry of an enclosure surrounding actuator 410(1) and cone 440(1) and/or gap 430(1) may be controlled by an actuator(s) including, without limitation, an electrostatic actuator, a piezoelectric actuator, a MEMS actuator, a thermal bimorph actuator, a motor, or a combination thereof.

FIG. 4B illustrates a cross section of an array of audio transducers that may, according to embodiments described herein, produce evanescent audio waves. Audio transducers 451(1) to 451(*n*) may include any type of transducer that converts electrical signals to air pressure waves. In some examples, audio transducers 451(1) to 451(*n*) may produce air pressure waves capable of being heard by a human auditory system. In some examples, audio transducers 451(1) to 451(*n*) may include actuators 411(1) to 411(*n*). Actuators 411(1) to 411(*n*) may drive cones 441(1) to 441(*n*) respectively such that cones 441(1) to 441(*n*) create a positive air pressure wave in direction 421. The positive air pressures waves created by cones 441(1) to 441(*n*) moving in direction 421 may create audible sound waves 461(1) to 461(*n*) that propagate away from audio transducers 451(1) to 451(*n*) respectively. In some examples, when actuators 411(1) to 411(*n*) drive cones 441(1) to 441(*n*) respectively such that cones 441(1) to 441(*n*) create a positive air pressure wave in direction 421, a negative air pressure wave may be simultaneously created on the opposite side of cones 441(1) to 441(*n*) in which the positive air pressure wave is created. The negative air pressures waves created by cones 441(1) to 441(*n*) moving in direction 421 may create audible sound waves 471(1) to 471(*n*) that propagate away from audio transducers 451(1) to 451(*n*), respectively. Actuators 411(1) to 411(*n*) and cones 441(1) to 441(*n*) respectively may be, without limitation, a monopole speaker, a dipole speaker, a bipole speaker, or a combination thereof.

In some examples, audible sound waves 461(1) to 461(*n*) and 471(1) to 471(*n*) may propagate away from audio transducers 451(1) to 451(*n*) in multiple directions such that the amplitude of the audible sound decreases with distance in substantially the same amount in each of the multiple directions.

In some examples, audible sound waves 461(1) to 461(*n*) and 471(1) to 471(*n*) may travel away from audio transducers 451(1) to 451(*n*) in multiple directions such that the audible sound waves decrease with distance according to an inverse square law in one direction and decrease exponentially with distance in a different direction. The direction in which the audible sound waves decrease exponentially with distance may be an evanescent sound wave and travel orthogonally to the direction in which the audible sound waves decrease according to an inverse square law.

In some examples, audio transducer 451(1) may produce an evanescent sound wave due to a cancellation and/or interference effect between sound waves 461(1) and 471(1). The cancellation and/or interference effect may result from the geometry of an enclosure surrounding actuator 411(1) and cone 441(1) and/or the geometry of gaps 431(1) to 431(*n*) and 436(1) to 436(*n*) through which the sound pressure wave produced by actuator 411(1) and cone 441(1) passes. As described above with respect to FIG. 3, switching between producing an evanescent audio wave and not producing an evanescent audio wave may be triggered by various events including, without limitation, a wearer interface event, a signal to noise ratio (SNR), an ambient audio level, or a combination thereof. In some examples, the switching may result from changing the geometry of an enclosure surrounding actuator 411(1) and cone 441(1). Changing the geometry of an enclosure surrounding actuator 411(1) and cone 441(1) may change the cancellation and/or interference effects between sound waves 461(1) and 471(1) thereby switching between producing an evanescent audio wave and not producing an evanescent audio wave. In some examples, changing the geometry of gaps 431(1) and 436(1) through which the sound pressure wave produced by actuator 411(1) and cone 441(1) passes may change the cancellation and/or interference effects between sound waves 461(1) and 471(1) thereby switching between producing an evanescent audio wave and not producing an evanescent audio wave. Changing the geometry of an enclosure surrounding actuator 411(1) and cone 441(1) and/or gaps 431(1) and 436(1) may be controlled by an actuator(s) including, without limitation, an electrostatic actuator, a piezoelectric actuator, a MEMS actuator, a thermal bimorph actuator, a motor, or a combination thereof.

Figure 5:
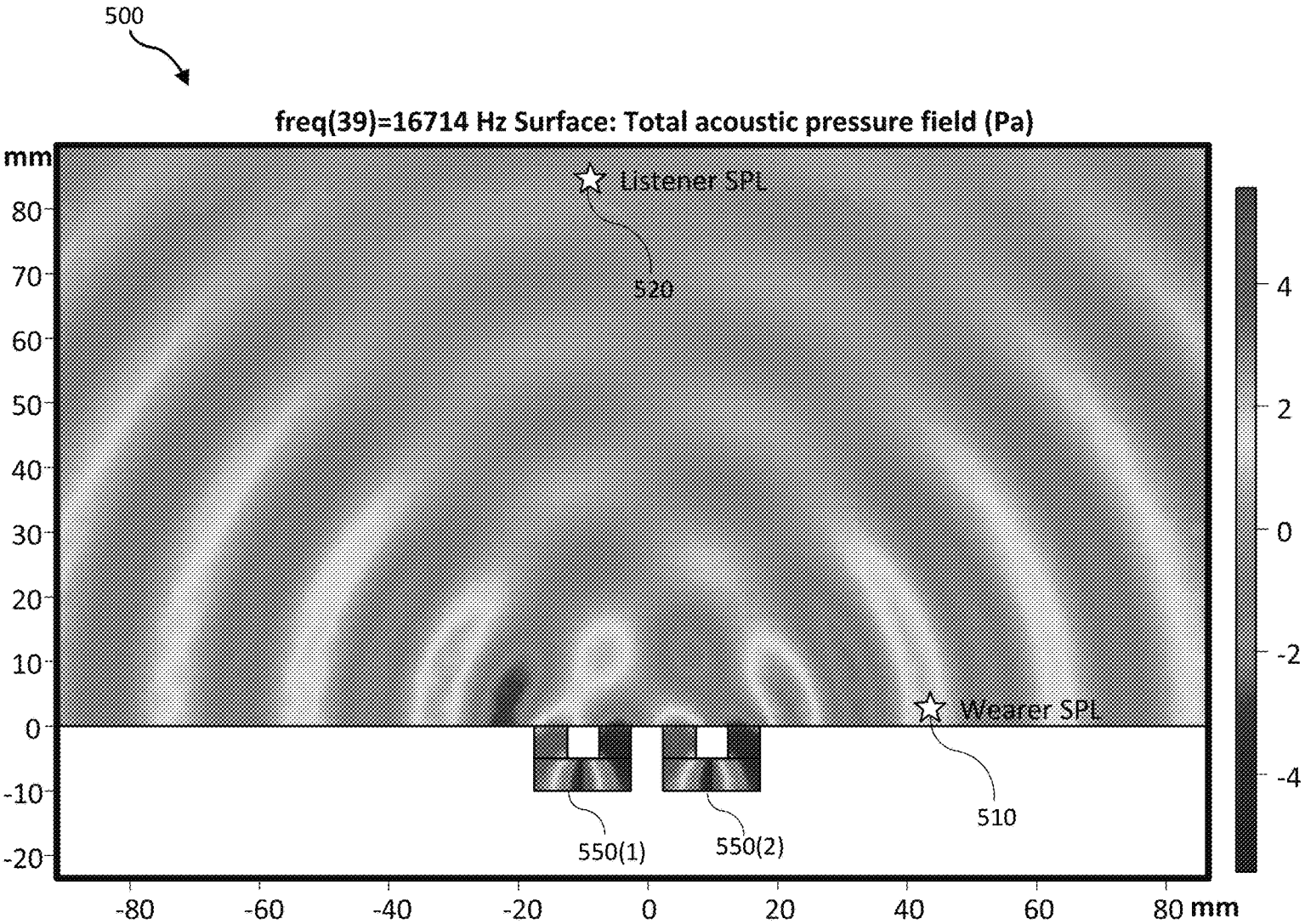
FIG. 5 illustrates a graph of sound pressure waves emitted from audio transducers.

FIG. 5 illustrates a graph 500 of sound pressure waves emitted from audio transducers (e.g., transducers 410 shown in FIG. 4A) that, in combination, may create evanescent audio waves. As shown in FIG. 5, audio transducers 550(1)

and 550(2) may emit sound pressure waves in multiple directions. The horizontal axis may represent a distance in millimeters from a center point between audio transducers 550(1) and 550(2). The vertical axis may represent a distance in millimeters from a point at which audio transducers 550(1) and 550(2) emit sound pressure waves. In some examples, audio transducers 550(1) and 550(2) may emit sound pressure waves that travel in multiple directions. The horizontal axis and the vertical axis may represent two of the multiple directions in which the sound pressure waves are emitted. The directions represented by the horizontal and vertical axis may be orthogonal to one another. Audio transducers 550(1) and 550(2) may emit sound pressure waves in the direction represented by the horizontal axis such that the sound pressure decays with distance according to an inverse square law (e.g., for each doubling of distance the sound pressure level decreases by 6 dB). Audio transducers 550(1) and 550(2) may emit sound pressure waves in the direction represented by the vertical axis such that the sound pressure decays significantly (e.g., exponentially) with distance from audio transducers 550(1) and 550(2). Audio transducers 550(1) and 550(2) may emit evanescent sound pressure waves in the direction represented by the vertical axis. In some examples, audio transducers 550(1) and 550(2) may be integrated into an audio reproduction headset that reproduces audio for a wearer of the audio reproduction headset. Wearer SPL 510 may represent a location of the wearer's ear relative to audio transducers 550(1) and 550(2) when the wearer is listening to audio content reproduced by the audio reproduction headset. Listener SPL 520 may represent a location of a listener's ear relative to audio transducers 550(1) and 550(2). In some examples, the wearer's ear may be located near audio transducers 550(1) and 550(2). In some examples, the wearer's ear may be located in the range of about 0 to 10 mm, about 10 to 20 mm, about 20 to 30 mm, about 30 to 40 mm, about 40 to 50 mm and/or about 50 to 60 mm from the center of audio transducers 550(1) and 550(2). In the example shown in FIG. 5, the wearer's ear may be located approximately 42 mm from the center of audio transducers 550(1) and 550(2).

As shown in FIG. 5, the sound pressure level at listener SPL 520 may be significantly lower than the sound pressure level at wearer SPL 510 due to the evanescent sound wave traveling towards listener SPL 520 decaying at an exponential rate as compared to the sound wave traveling towards wearer SPL 510 decreasing at a rate according to an inverse square law. In some examples, a wearer of an audio reproduction headset including audio transducers 550(1) and 550(2) may listen to audio content at an acceptable sound level while a nearby listener may not hear the reproduced sound thereby eliminating a potential annoyance to the nearby listener.

Figure 6:
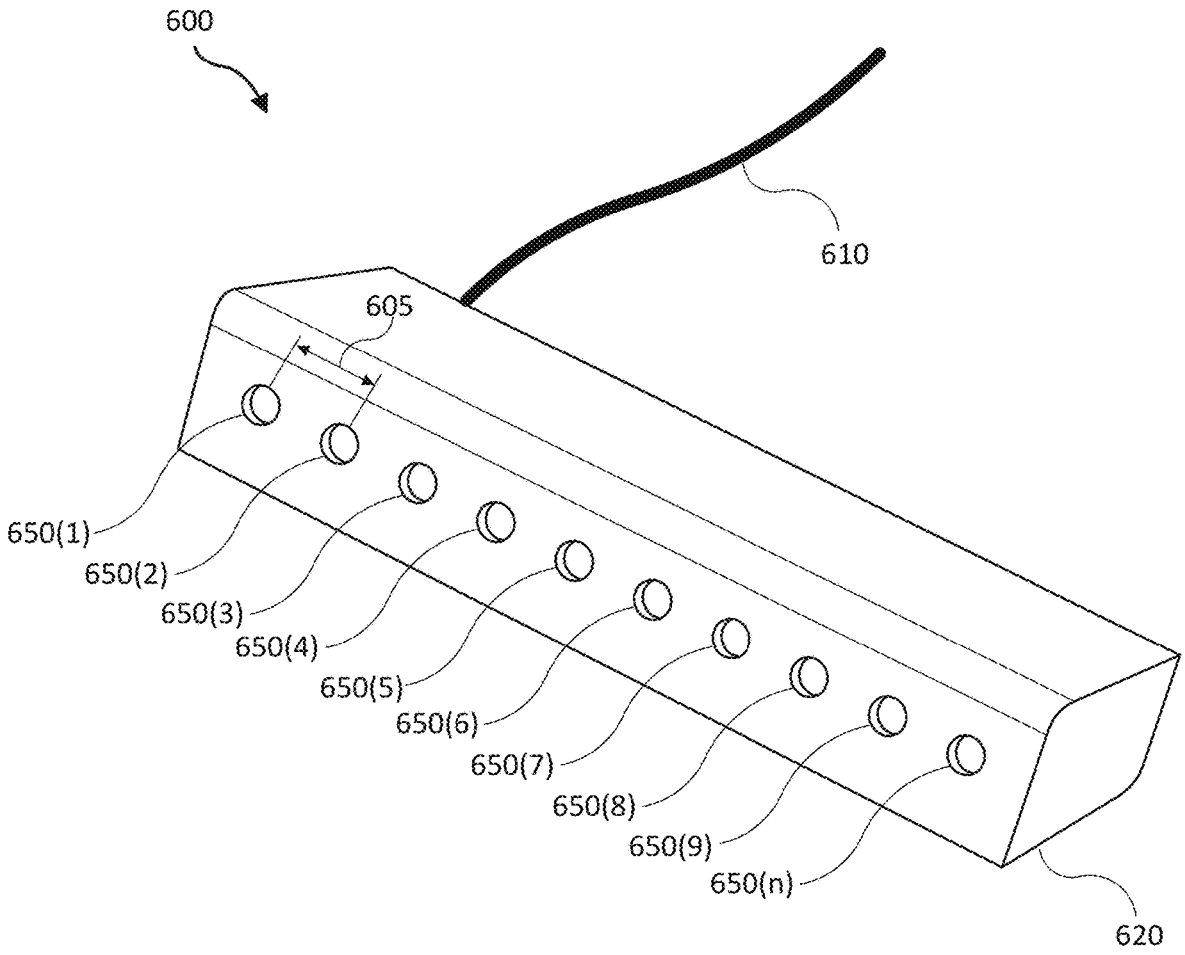
FIG. 6 illustrates a perspective view of an array of audio transducers.

FIG. 6 illustrates a perspective view of a system 600 with an array of audio transducers capable of producing evanescent audio waves. As shown in FIG. 6, audio transducer array 620 may include audio transducers 650(1) to 650(*n*). Audio transducers 650(1) to 650(*n*) may include any type of transducer that converts electrical signals to air pressure waves. In some examples, audio transducers 450(1) to 450(*n*) may produce air pressure waves capable of being heard by a human auditory system. In FIG. 6, audio transducer array 620 shows ten audio transducers; however, audio transducer array 620 may have any number of audio transducers. In some examples, audio transducer array 620 may include a single audio transducer. Further, FIG. 6 shows audio transducers 650(1) to 650(*n*) in a linear array; however, audio transducers 650(1) to 650(*n*) may be arranged in any configuration including, without limitation, curvilinear, two-dimensional, three-dimensional, phased array, endfire, or a combination thereof.

In some examples, spacing distance 605 may represent the center-to-center distance between each of audio transducers 650(1) to 650(*n*). Spacing distance 605 may be compact. In some examples, spacing distance 605 may be based on the wavelength of the audio produced by audio transducers 650(1) to 650(*n*) divided by an integer. In some examples, spacing distance 605 may be the wavelength of the audio produced by audio transducers 650(1) to 650(*n*) divided by an integer. In some examples, spacing distance 605 may be the wavelength of the audio produced by audio transducers 650(1) to 650(*n*) divided by two. Spacing distance 605 may be designed to create a representation of a wavelength in the air surrounding audio transducer array 620 at a frequency the air is unable to support as a propagating wave. Spacing distance 605 between adjacent audio transducers 650(1) to 650(*n*) may be determined using any suitable method. In some examples, spacing distance 605 may be determined based on Equation (1) below, where d may be the spacing distance 605 between adjacent audio transducers 650(1) to 650(*n*), $\lambda_{apparent}$ may be a half wavelength of the frequency of the audio signal, $\lambda_{fluid}$ may be the wavelength the air is able to support as a propagating wave, c may be the speed of sound in air, and f may be the frequency of the audio signal.

$$2 \cdot d = \lambda_{apparent} < \lambda_{fluid} = cf \tag{1}$$

The wavelength of the audio produced by audio transducers 650(1) to 650(*n*) may include a range of wavelengths. The range of wavelengths may correspond to the range of frequencies of sound that may be heard by the human auditory system. In some examples, the range of frequencies may be from about 20 Hz to about 20,000 Hz.

As described in detail above with respect to FIG. 3, audio transducers 650(1) to 650(*n*) may be driven by different phases of an audio actuation signal. For example, audio transducer 650(1) may be driven by an in-phase actuation signal while audio transducer 650(2) may be driven by an out-of-phase actuation signal (e.g., 180 degrees out of phase, 179 degrees out of phase, or another phase shift). Similarly, each pair of adjacent audio transducers (e.g., audio transducers 650(1) and 650(2), audio transducers 650(3) and 650(4), audio transducers 650(5) and 650(6), audio transducers 650(7) and 650(8), and audio transducers 650(9) and 650(*n*)), may be driven by an in-phase actuation signal and an out-of-phase actuation signal as described with respect to audio transducers 650(1) and 650(2). In some examples, audio transducer array 620 may produce an evanescent sound wave due to a cancellation and/or interference effect between sound waves emitted from adjacent audio transducers when driven by different phases of the actuation signal.

In some examples, audio signals may be provided to audio transducer array 620 by cable 610. Cable 610 may provide audio signals in analog and/or digital form. The audio signals may be, without limitation, discrete, multiplexed, networked, or a combination thereof.

In some examples, audio transducers 650(1) to 650(*n*) may control the direction of travel of audio waves through any method. Audio transducers 650(1) to 650(*n*) may control the direction of travel of audio waves through beamforming. Controlling the direction of travel of audio waves through beamforming may include, without limitation, controlling the phases of the audio signals driving audio transducers 650(1) to 650(n), controlling the amplitudes of the audio signals driving audio transducers 650(1) to 650(n), using cancellation/interference effects between adjacent audio transducers, or a combination thereof. Beamforming the emitted audio waves may increase a difference in sound pressure levels between those received by a nearby listener and a wearer of an audio reproduction headset incorporating audio transducer array 620. As discussed below with respect to FIG. 10, beamforming may also be used to vary the gain and/or directional sensitivity of an audio reproduction headset incorporating a microphone array. In some cases, increasing the distance between acoustic sensors of the microphone array may improve the accuracy of beamforming performed via the microphone array.

Figure 7:
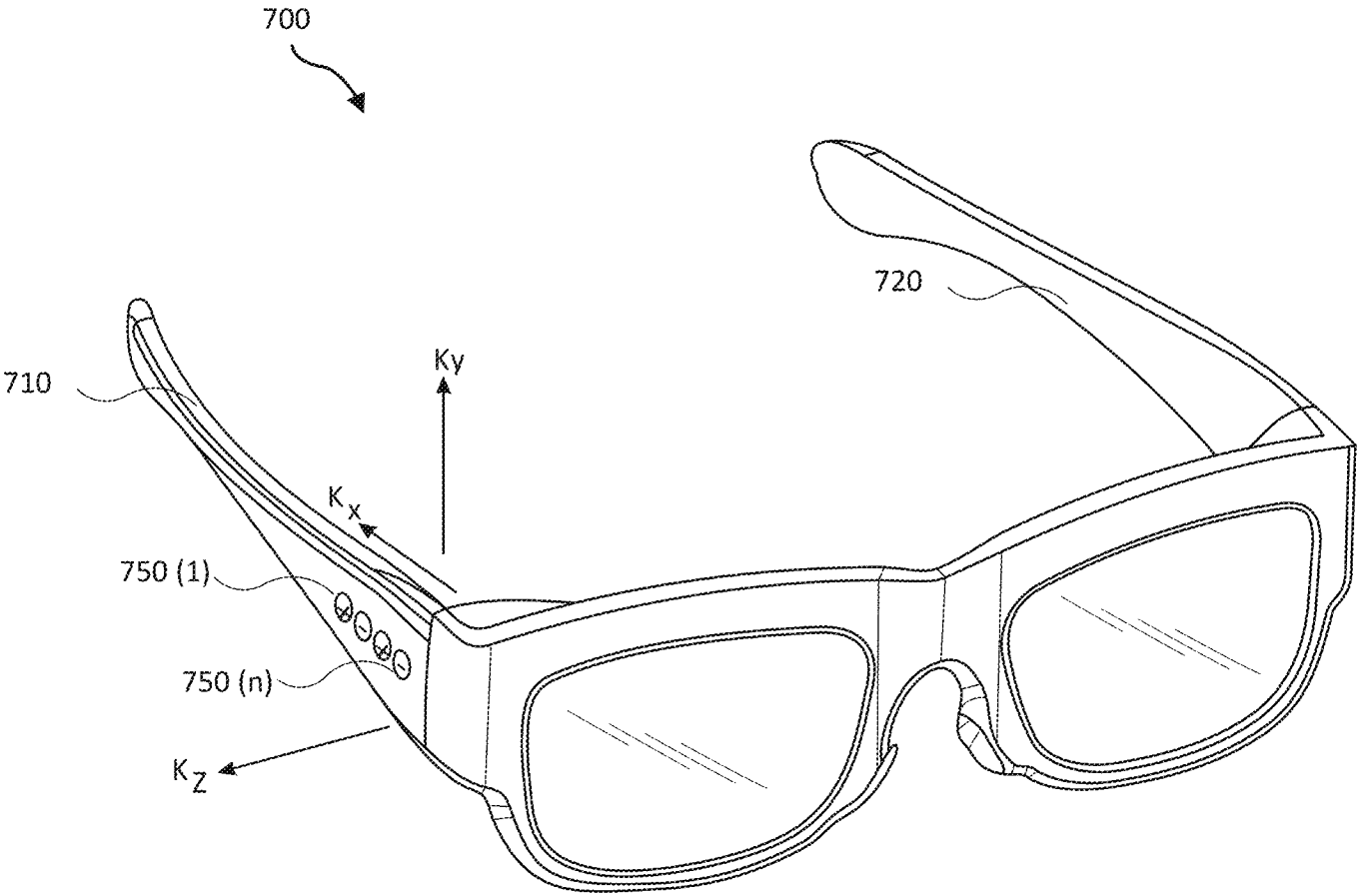
FIG. 7 illustrates a perspective view of a head-mounted display system including an array of audio transducers.

FIG. 7 illustrates a perspective view of a head-mounted display system 700 including an array of audio transducers. Head mounted display system 700 may include an eyewear device. Head mounted display system 700 may include any type of audio transducers that provide sound waves to a wearer of head mounted display system 700. In some examples, head mounted display system 700 may include array of audio transducers 750(1) to 750(n). In some examples, head mounted display system 700 may include a single audio transducer. Audio transducers 750(1) to 750(n) may be integrated into any portion of head mounted display system 700. In some examples, audio transducers 750(1) to 750(n) may be integrated into side support structure 710 of head mounted display system 700. Although the perspective view of head mounted display system 700 shows a single array of audio transducers 750(1) to 750(n) included in side support structure 710 on one side of head mounted display system 700, head mounted display system 700 may include multiple arrays of audio transducers including an array on side support structure 720. Although array of audio transducers 750(1) to 750(n) is shown in FIG. 7 as a linear array, the present embodiment is not limited to a linear array and audio transducers 750(1) to 750(n) may include multidimensional arrays. Array of audio transducers 750(1) to 750(n) may also be integrated into other forms of head-mounted display systems. For example, array of audio transducers 750(1) to 750(n) may be integrated into the wearable device shown in FIG. 9. In some examples, output audio transducers 908(A) and 908(B) of FIG. 9 may include array of audio transducers 750(1) to 750(n). Array of audio transducers 750(1) to 750(n) may also be integrated into the wearable device shown in FIG. 10. In some examples, frame 1010 of FIG. 10 may include array of audio transducers 750(1) to 750(n) positioned in a suitable location that may provide audio content to a wearer of system 1000 while reducing leakage of audio to nearby listeners. Array of audio transducers 750(1) to 750(n) may also be integrated into the wearable device shown in FIG. 11. In some examples, output audio transducers 1106(A) and 1106(B) of FIG. 11 may include array of audio transducers 750(1) to 750(n). Array of audio transducers 750(1) to 750(n) may also be positioned in a suitable location on system 1100 including on and/or near front rigid body 1102 and/or band 1104.

Array of audio transducers 750(1) to 750(n) may emit any type of audio wave. In some examples, array of audio transducers 750(1) to 750(n) may emit propagating audio waves and/or evanescent audio waves. Array of audio transducers 750(1) to 750(n) may emit propagating audio waves in any direction. In some examples, array of audio transducers 750(1) to 750(n) may emit propagating audio waves in direction Kx that may be directed towards the ear of a wearer of head mounted display system 700. Array of audio transducers 750(1) to 750(n) may emit evanescent audio waves in any direction. In some examples, array of audio transducers 750(1) to 750(n) may emit evanescent audio waves in direction Ky and/or Kz that may be directed towards a listener near a wearer of head mounted display system 700. The propagating audio waves directed towards the ear of a wearer of head mounted display system 700 may allow the wearer to listen to audio content at a volume that may be satisfactory to the wearer, while the evanescent audio waves directed towards a listener near a wearer of head mounted display system 700 may exponentially decay while traveling towards the listener such that the listener may not hear the audio content or the audio content may arrive at a listener's ear at a volume that does not annoy the listener.

Figure 8:
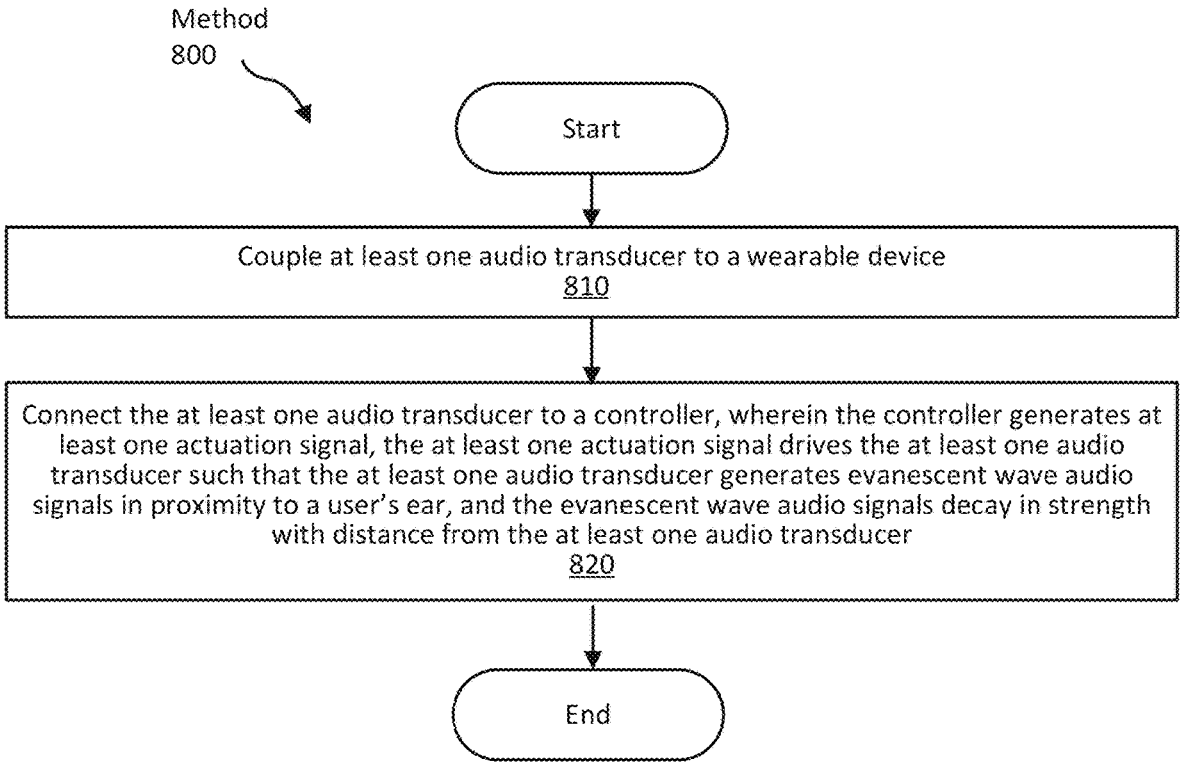
FIG. 8 illustrates a flow chart of a method of producing an evanescent audio wave with an audio transducer.

FIG. 8 illustrates a flow chart of an example method 800 of producing an evanescent audio wave with at least one audio transducer. As shown in FIG. 8, the method may include, at step 810, coupling at least one audio transducer to a wearable device. Coupling at least one audio transducer to a wearable device may include integrating the at least one audio transducer into the wearable device such that a wearer of the device may privately consume audio content produced by the at least one audio transducer at an acceptable sound volume level while avoiding annoyance to others nearby who may not wish to hear the audio content. In some examples, the at least one audio transducer may be integrated into a portion of the wearable device and positioned relative to the wearer's ears such that the audio content produced by the at least one audio transducer propagates in a direction towards the wearer's ears and decreases exponentially with distance in at least one direction different than towards the wearer's ears. In some examples, the wearable device may be a virtual reality device, an augmented reality device, a mixed reality device, a hybrid reality device, or some combination and/or derivative thereof. In some examples, the wearable device may be in the form of an eyewear frame. The at least one audio transducer may be integrated into the temples of an eyewear frame as shown in FIG. 7.

At step 820, the method may include connecting the at least one audio transducer to a controller such that the controller generates at least one actuation signal, the at least one actuation signal may drive the at least one audio transducer such that the at least one audio transducer generates evanescent wave audio signals in proximity to a wearer's ear and the evanescent wave audio signals decay with distance from the at least one audio transducer. The controller may generate at least one actuation signal to actuate the at least one audio transducer. An audio source may provide any suitable type of audio content to the controller as described above with respect to FIG. 3. In some examples, the controller may decode the audio content, convert the audio content to an analog audio signal, and provide the analog audio signal to an amplifier. In some examples, the amplifier may control the amplitude of the analog audio signal and drive the at least one audio transducer. The amplifier may control the amplitude of the analog audio signal using any type of suitable amplifier that may vary the amplitude of the analog audio signal. In some examples, the controller may also control a PAPC. The PAPC may shift the phase of the analog audio signal output from the amplifier. The PAPC may vary the phase of the analog audio signal over the range of 0 to 360 degrees using any type of suitable phase shifting method.

Ear-adjacent audio transducers, such as those shown in the example of FIG. 7, may emit sound waves in an evanescent mode in at least one direction. Emitting sound waves in an evanescent mode may be advantageous for minimizing the acoustic leakage to nearby listeners, thereby keeping audio content presented to the wearer private. Evanescent sound waves may significantly decrease with travel distance and the overall acoustic output level from the ear-adjacent audio transducers may be reduced in at least one direction. The methods described herein may allow an array of ear-adjacent audio transducers, in conjunction with an SNR-estimation scheme as described in detail above, to switch between propagating operation when maximum sound volume is desired and evanescent operation when minimum sound leakage is desired.

Embodiments of the instant disclosure may include or be implemented in conjunction with various types of artificial reality systems. Artificial reality is a form of reality that has been adjusted in some manner before presentation to a user, which may include, e.g., a virtual reality (VR), an augmented reality (AR), a mixed reality (MR), a hybrid reality, or some combination and/or derivative thereof. Artificial reality content may include completely generated content or generated content combined with captured (e.g., real-world) content. The artificial reality content may include video, audio, haptic feedback, or some combination thereof, any of which may be presented in a single channel or in multiple channels (such as stereo video that produces a three-dimensional effect to the viewer). Additionally, in some embodiments, artificial reality may also be associated with applications, products, accessories, services, or some combination thereof, that are used to, e.g., create content in an artificial reality and/or are otherwise used in (e.g., to perform activities in) an artificial reality.

Artificial reality systems may be implemented in a variety of different form factors and configurations. Some artificial reality systems may be designed to work without near-eye displays (NEDs), an example of which is AR system 900 in FIG. 9. Other artificial reality systems may include an NED that also provides visibility into the real world (e.g., AR system 1000 in FIG. 10) or that visually immerses a user in an artificial reality (e.g., VR system 1100 in FIG. 11). While some artificial reality devices may be self-contained systems, other artificial reality devices may communicate and/or coordinate with external devices to provide an artificial reality experience to a user. Examples of such external devices include handheld controllers, mobile devices, desktop computers, devices worn by a user, devices worn by one or more other users, and/or any other suitable external system.

Figure 9:
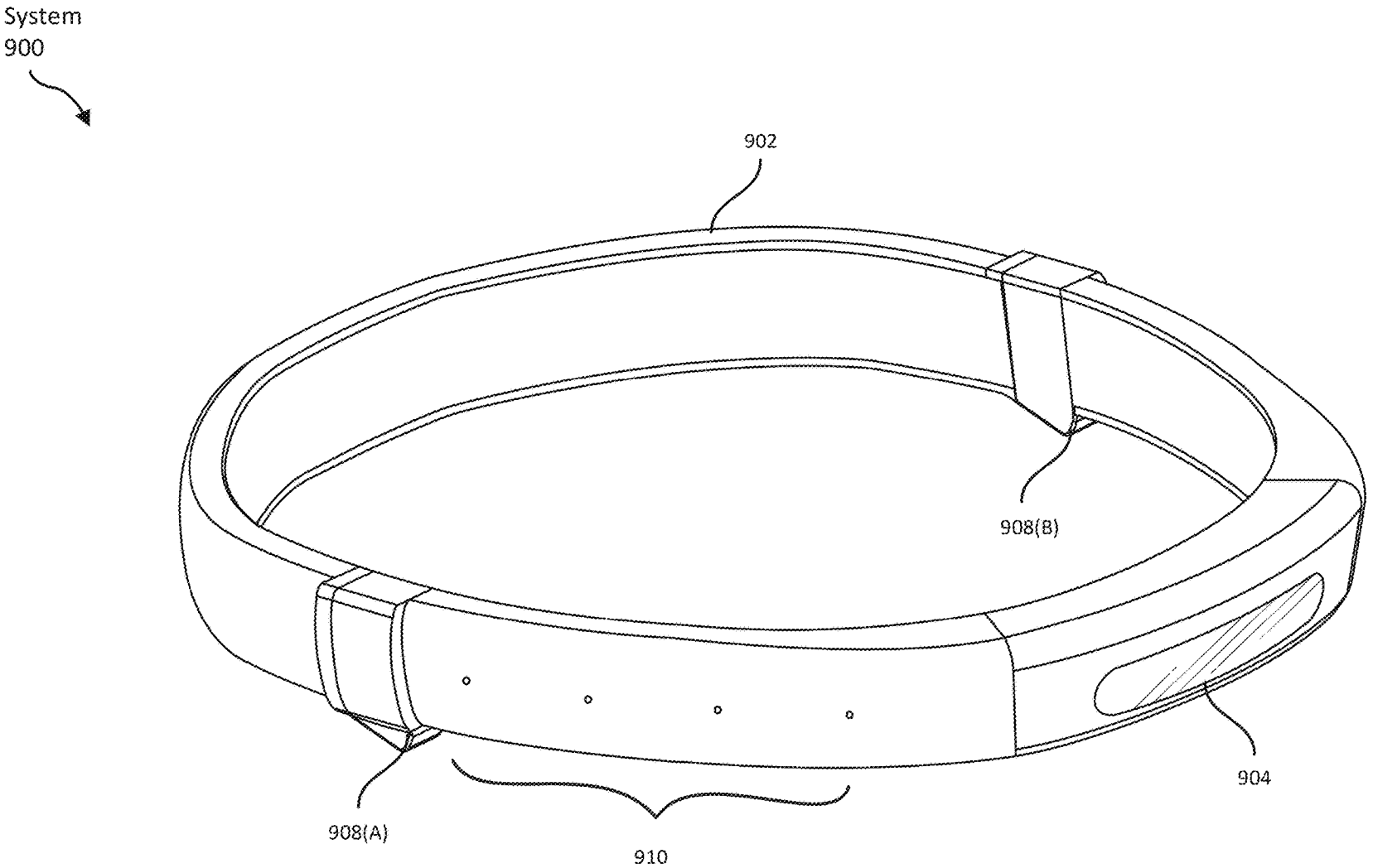
FIG. 9 illustrates an example of an augmented reality system.

Turning to FIG. 9, AR system 900 generally represents a wearable device dimensioned to fit about a body part (e.g., a head) of a user. As shown in FIG. 9, system 900 may include a frame 902 and a camera assembly 904 that is coupled to frame 902 and configured to gather information about a local environment by observing the local environment. AR system 900 may also include one or more audio devices, such as output audio transducers 908(A) and 908(B) and input audio transducers 910. Output audio transducers 908(A) and 908(B) may provide audio feedback and/or content to a user, and input audio transducers 910 may capture audio in a user's environment.

As shown, AR system 900 may not necessarily include an NED positioned in front of a user's eyes. AR systems without NEDs may take a variety of forms, such as head bands, hats, hair bands, belts, watches, wrist bands, ankle bands, rings, neckbands, necklaces, chest bands, eyewear frames, and/or any other suitable type or form of apparatus. While AR system 900 may not include an NED, AR system 900 may include other types of screens or visual feedback devices (e.g., a display screen integrated into a side of frame 902).

Figure 10:
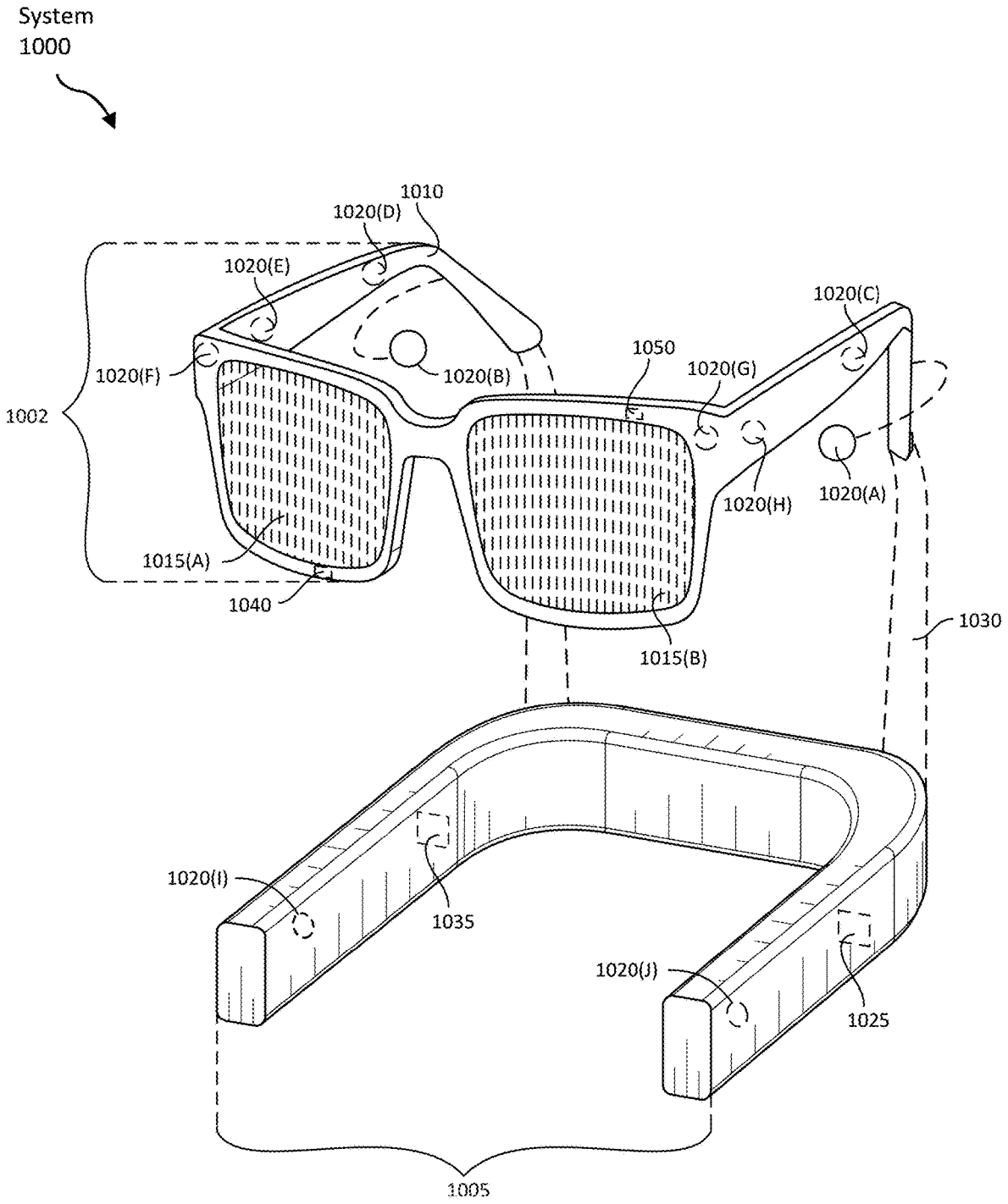
FIG. 10 illustrates another example of an augmented reality system.

The embodiments discussed in this disclosure may also be implemented in AR systems that include one or more NEDs. For example, as shown in FIG. 10, AR system 1000 may include an eyewear device 1002 with a frame 1010 configured to hold a left display device 1015(A) and a right display device 1015(B) in front of a user's eyes. Display devices 1015(A) and 1015(B) may act together or independently to present an image or series of images to a user. While AR system 1000 includes two displays, embodiments of this disclosure may be implemented in AR systems with a single NED or more than two NEDs.

In some embodiments, AR system 1000 may include one or more sensors, such as sensor 1040. Sensor 1040 may generate measurement signals in response to motion of AR system 1000 and may be located on substantially any portion of frame 1010. Sensor 1040 may include a position sensor, an inertial measurement unit (IMU), a depth camera assembly, or any combination thereof. In some embodiments, AR system 1000 may or may not include sensor 1040 or may include more than one sensor. In embodiments in which sensor 1040 includes an IMU, the IMU may generate calibration data based on measurement signals from sensor 1040. Examples of sensor 1040 may include, without limitation, accelerometers, gyroscopes, magnetometers, other suitable types of sensors that detect motion, sensors used for error correction of the IMU, or some combination thereof.

AR system 1000 may also include a microphone array with a plurality of acoustic sensors 1020(A)-1020(J), referred to collectively as acoustic sensors 1020. Acoustic sensors 1020 may be transducers that detect air pressure variations induced by sound waves. Each acoustic sensor 1020 may be configured to detect sound and convert the detected sound into an electronic format (e.g., an analog or digital format). The microphone array in FIG. 10 may include, for example, ten acoustic sensors: 1020(A) and 1020(B), which may be designed to be placed inside a corresponding ear of the user, acoustic sensors 1020(C), 1020(D), 1020(E), 1020(F), 1020(G), and 1020(H), which may be positioned at various locations on frame 1010, and/or acoustic sensors 1020(1) and 1020(J), which may be positioned on a corresponding neckband 1005.

The configuration of acoustic sensors 1020 of the microphone array may vary. While AR system 1000 is shown in FIG. 10 as having ten acoustic sensors 1020, the number of acoustic sensors 1020 may be greater or less than ten. In some embodiments, using higher numbers of acoustic sensors 1020 may increase the amount of audio information collected and/or the sensitivity and accuracy of the audio information. In contrast, using a lower number of acoustic sensors 1020 may decrease the computing power required by the controller 1050 to process the collected audio information. In addition, the position of each acoustic sensor 1020 of the microphone array may vary. For example, the position of an acoustic sensor 1020 may include a defined position on the user, a defined coordinate on the frame 1010, an orientation associated with each acoustic sensor, or some combination thereof.

Acoustic sensors 1020(A) and 1020(B) may be positioned on different parts of the user's ear, such as behind the pinna or within the auricle or fossa. Or, there may be additional acoustic sensors on or surrounding the ear in addition to acoustic sensors 1020 inside the ear canal. Having an acoustic sensor positioned next to an ear canal of a user may enable the microphone array to collect information on how sounds arrive at the ear canal. By positioning at least two of acoustic sensors 1020 on either side of a user's head (e.g., as binaural microphones), AR device 1000 may simulate binaural hearing and capture a 3D stereo sound field around about a user's head. In some embodiments, the acoustic sensors 1020(A) and 1020(B) may be connected to the AR system 1000 via a wired connection, and in other embodiments, the acoustic sensors 1020(A) and 1020(B) may be connected to the AR system 1000 via a wireless connection (e.g., a Bluetooth connection). In still other embodiments, the acoustic sensors 1020(A) and 1020(B) may not be used at all in conjunction with the AR system 1000.

Acoustic sensors 1020 on frame 1010 may be positioned along the length of the temples, across the bridge, above or below display devices 1015(A) and 1015(B), or some combination thereof. Acoustic sensors 1020 may be oriented such that the microphone array is able to detect sounds in a wide range of directions surrounding the user wearing the AR system 1000. In some embodiments, an optimization process may be performed during manufacturing of AR system 1000 to determine relative positioning of each acoustic sensor 1020 in the microphone array.

AR system 1000 may further include or be connected to an external device. (e.g., a paired device), such as neckband 1005. As shown, neckband 1005 may be coupled to eyewear device 1002 via one or more connectors 1030. The connectors 1030 may be wired or wireless connectors and may include electrical and/or non-electrical (e.g., structural) components. In some cases, the eyewear device 1002 and the neckband 1005 may operate independently without any wired or wireless connection between them. While FIG. 10 illustrates the components of eyewear device 1002 and neckband 1005 in example locations on eyewear device 1002 and neckband 1005, the components may be located elsewhere and/or distributed differently on eyewear device 1002 and/or neckband 1005. In some embodiments, the components of the eyewear device 1002 and neckband 1005 may be located on one or more additional peripheral devices paired with eyewear device 1002, neckband 1005, or some combination thereof. Furthermore, neckband 1005 generally represents any type or form of paired device. Thus, the following discussion of neckband 1005 may also apply to various other paired devices, such as smart watches, smart phones, wrist bands, other wearable devices, handheld controllers, tablet computers, laptop computers, etc.

Pairing external devices, such as neckband 1005, with AR eyewear devices may enable the eyewear devices to achieve the form factor of a pair of glasses while still providing sufficient battery and computation power for expanded capabilities. Some or all of the battery power, computational resources, and/or additional features of AR system 1000 may be provided by a paired device or shared between a paired device and an eyewear device, thus reducing the weight, heat profile, and form factor of the eyewear device overall while still retaining desired functionality. For example, neckband 1005 may allow components that would otherwise be included on an eyewear device to be included in neckband 1005 since users may tolerate a heavier weight load on their shoulders than they would tolerate on their heads. Neckband 1005 may also have a larger surface area over which to diffuse and disperse heat to the ambient environment. Thus, neckband 1005 may allow for greater battery and computation capacity than might otherwise have been possible on a stand-alone eyewear device. Since weight carried in neckband 1005 may be less invasive to a user than weight carried in eyewear device 1002, a user may tolerate wearing a lighter eyewear device and carrying or wearing the paired device for greater lengths of time than the user would tolerate wearing a heavy standalone eyewear device, thereby enabling an artificial reality environment to be incorporated more fully into a user's day-to-day activities.

Neckband 1005 may be communicatively coupled with eyewear device 1002 and/or to other devices. The other devices may provide certain functions (e.g., tracking, localizing, depth mapping, processing, storage, etc.) to the AR system 1000. In the embodiment of FIG. 10, neckband 1005 may include two acoustic sensors (e.g., 1020(1) and 1020(J)) that are part of the microphone array (or potentially form their own microphone subarray). Neckband 1005 may also include a controller 1025 and a power source 1035.

Acoustic sensors 1020(1) and 1020(J) of neckband 1005 may be configured to detect sound and convert the detected sound into an electronic format (analog or digital). In the embodiment of FIG. 10, acoustic sensors 1020(1) and 1020(J) may be positioned on neckband 1005, thereby increasing the distance between the neckband acoustic sensors 1020(1) and 1020(J) and other acoustic sensors 1020 positioned on eyewear device 1002. In some cases, increasing the distance between acoustic sensors 1020 of the microphone array may improve the accuracy of beamforming performed via the microphone array. For example, if a sound is detected by acoustic sensors 1020(C) and 1020(D) and the distance between acoustic sensors 1020(C) and 1020(D) is greater than, e.g., the distance between acoustic sensors 1020(D) and 1020(E), the determined source location of the detected sound may be more accurate than if the sound had been detected by acoustic sensors 1020(D) and 1020(E).

Controller 1025 of neckband 1005 may process information generated by the sensors on neckband 1005 and/or AR system 1000. For example, controller 1025 may process information from the microphone array that describes sounds detected by the microphone array. For each detected sound, controller 1025 may perform a DoA estimation to estimate a direction from which the detected sound arrived at the microphone array. As the microphone array detects sounds, controller 1025 may populate an audio data set with the information. In embodiments in which AR system 1000 includes an inertial measurement unit, controller 1025 may compute all inertial and spatial calculations from the IMU located on eyewear device 1002. Connector 1030 may convey information between AR system 1000 and neckband 1005 and between AR system 1000 and controller 1025. The information may be in the form of optical data, electrical data, wireless data, or any other transmittable data form. Moving the processing of information generated by AR system 1000 to neckband 1005 may reduce weight and heat in eyewear device 1002, making it more comfortable to the user.

Power source 1035 in neckband 1005 may provide power to eyewear device 1002 and/or to neckband 1005. Power source 1035 may include, without limitation, lithium ion batteries, lithium-polymer batteries, primary lithium batteries, alkaline batteries, or any other form of power storage. In some cases, power source 1035 may be a wired power source. Including power source 1035 on neckband 1005 instead of on eyewear device 1002 may help better distribute the weight and heat generated by power source 1035.

As noted, some artificial reality systems may, instead of blending an artificial reality with actual reality, substantially replace one or more of a user's sensory perceptions of the real world with a virtual experience. One example of this type of system is a head-worn display system, such as VR system 1100 in FIG. 11, that mostly or completely covers a user's field of view. VR system 1100 may include a front rigid body 1102 and a band 1104 shaped to fit around a user's head. VR system 1100 may also include output audio transducers 1106(A) and 1106(B). Furthermore, while not shown in FIG. 11, front rigid body 1102 may include one or more electronic elements, including one or more electronic displays, one or more inertial measurement units (IMUS), one or more tracking emitters or detectors, and/or any other suitable device or system for creating an artificial reality experience.

Artificial reality systems may include a variety of types of visual feedback mechanisms. For example, display devices in AR system 1000 and/or VR system 1100 may include one or more liquid crystal displays (LCDs), light emitting diode (LED) displays, organic LED (OLED) displays, and/or any other suitable type of display screen. Artificial reality systems may include a single display screen for both eyes or may provide a display screen for each eye, which may allow for additional flexibility for varifocal adjustments or for correcting a user's refractive error. Some artificial reality systems may also include optical subsystems having one or more lenses (e.g., conventional concave or convex lenses, Fresnel lenses, adjustable liquid lenses, etc.) through which a user may view a display screen.

In addition to or instead of using display screens, some artificial reality systems may include one or more projection systems. For example, display devices in AR system 1000 and/or VR system 1100 may include micro-LED projectors that project light (using, e.g., a waveguide) into display devices, such as clear combiner lenses that allow ambient light to pass through. The display devices may refract the projected light toward a user's pupil and may enable a user to simultaneously view both artificial reality content and the real world. Artificial reality systems may also be configured with any other suitable type or form of image projection system.

Artificial reality systems may also include various types of computer vision components and subsystems. For example, AR system 900, AR system 1000, and/or VR system 1100 may include one or more optical sensors such as two-dimensional (2D) or three-dimensional (3D) cameras, time-of-flight depth sensors, single-beam or sweeping laser rangefinders, 3D LiDAR sensors, and/or any other suitable type or form of optical sensor. An artificial reality system may process data from one or more of these sensors to identify a location of a user, to map the real world, to provide a user with context about real-world surroundings, and/or to perform a variety of other functions.

Artificial reality systems may also include one or more input and/or output audio transducers. In the examples shown in FIGS. 9 and 11, output audio transducers 908(A), 908(B), 1106(A), and 1106(B) may include voice coil speakers, ribbon speakers, electrostatic speakers, piezoelectric speakers, bone conduction transducers, cartilage conduction transducers, and/or any other suitable type or form of audio transducer. Similarly, input audio transducers 910 may include condenser microphones, dynamic microphones, ribbon microphones, and/or any other type or form of input transducer. In some embodiments, a single transducer may be used for both audio input and audio output.

Figure 11:
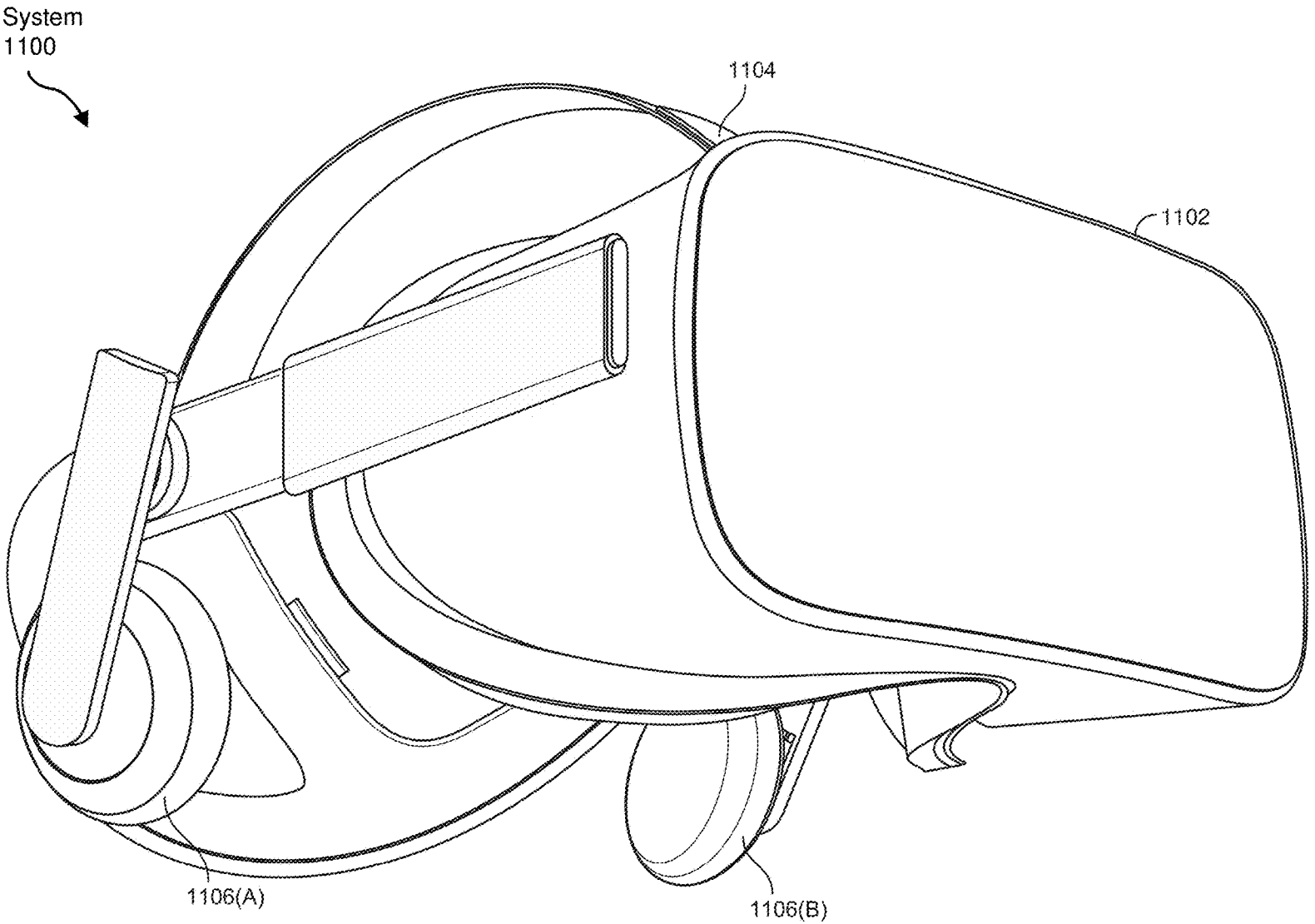
FIG. 11 illustrates an example of a virtual reality system.

While not shown in FIGS. 9-11, artificial reality systems may include tactile (i.e., haptic) feedback systems, which may be incorporated into headwear, gloves, body suits, handheld controllers, environmental devices (e.g., chairs, floormats, etc.), and/or any other type of device or system. Haptic feedback systems may provide various types of cutaneous feedback, including vibration, force, traction, texture, and/or temperature. Haptic feedback systems may also provide various types of kinesthetic feedback, such as motion and compliance. Haptic feedback may be implemented using motors, piezoelectric actuators, fluidic systems, and/or a variety of other types of feedback mechanisms. Haptic feedback systems may be implemented independent of other artificial reality devices, within other artificial reality devices, and/or in conjunction with other artificial reality devices.

By providing haptic sensations, audible content, and/or visual content, artificial reality systems may create an entire virtual experience or enhance a user's real-world experience in a variety of contexts and environments. For instance, artificial reality systems may assist or extend a user's perception, memory, or cognition within a particular environment. Some systems may enhance a user's interactions with other people in the real world or may enable more immersive interactions with other people in a virtual world. Artificial reality systems may also be used for educational purposes (e.g., for teaching or training in schools, hospitals, government organizations, military organizations, business enterprises, etc.), entertainment purposes (e.g., for playing video games, listening to music, watching video content, etc.), and/or for accessibility purposes (e.g., as hearing aids, visuals aids, etc.). The embodiments disclosed herein may enable or enhance a user's artificial reality experience in one or more of these contexts and environments and/or in other contexts and environments.

Some AR systems may map a user's environment using techniques referred to as "simultaneous location and mapping" (SLAM). SLAM mapping and location identifying techniques may involve a variety of hardware and software tools that can create or update a map of an environment while simultaneously keeping track of a user's location within the mapped environment. SLAM may use many different types of sensors to create a map and determine a user's position within the map.

SLAM techniques may, for example, implement optical sensors to determine a user's location. Radios including WiFi, Bluetooth, global positioning system (GPS), cellular or other communication devices may be also used to determine a user's location relative to a radio transceiver or group of transceivers (e.g., a WiFi router or group of GPS satellites). Acoustic sensors such as microphone arrays or 2D or 3D sonar sensors may also be used to determine a user's location within an environment. AR and VR devices (such as systems 900, 1000, and 1100 of FIGS. 9 and 10, respectively) may incorporate any or all of these types of sensors to perform SLAM operations such as creating and continually updating maps of the user's current environment. In at least some of the embodiments described herein, SLAM data generated by these sensors may be referred to as "environmental data" and may indicate a user's current environment. This data may be stored in a local or remote data store (e.g., a cloud data store) and may be provided to a user's AR/VR device on demand.

When the user is wearing an AR headset or VR headset in a given environment, the user may be interacting with other users or other electronic devices that serve as audio sources. In some cases, it may be desirable to determine where the audio sources are located relative to the user and then present the audio sources to the user as if they were coming from the location of the audio source. The process of determining where the audio sources are located relative to the user may be referred to herein as "localization," and the process of rendering playback of the audio source signal to appear as if it is coming from a specific direction may be referred to herein as "spatialization."

Localizing an audio source may be performed in a variety of different ways. In some cases, an AR or VR headset may initiate a direction of arrival (DOA) analysis to determine the location of a sound source. The DOA analysis may include analyzing the intensity, spectra, and/or arrival time of each sound at the AR/VR device to determine the direction from which the sounds originated. In some cases, the DOA analysis may include any suitable algorithm for analyzing the surrounding acoustic environment in which the artificial reality device is located.

For example, the DOA analysis may be designed to receive input signals from a microphone and apply digital signal processing algorithms to the input signals to estimate the direction of arrival. These algorithms may include, for example, delay and sum algorithms where the input signal is sampled, and the resulting weighted and delayed versions of the sampled signal are averaged together to determine a direction of arrival. A least mean squared (LMS) algorithm may also be implemented to create an adaptive filter. This adaptive filter may then be used to identify differences in signal intensity, for example, or differences in time of arrival. These differences may then be used to estimate the direction of arrival. In another embodiment, the DOA may be determined by converting the input signals into the frequency domain and selecting specific bins within the time-frequency (TF) domain to process. Each selected TF bin may be processed to determine whether that bin includes a portion of the audio spectrum with a direct-path audio signal. Those bins having a portion of the direct-path signal may then be analyzed to identify the angle at which a microphone array received the direct-path audio signal. The determined angle may then be used to identify the direction of arrival for the received input signal. Other algorithms not listed above may also be used alone or in combination with the above algorithms to determine DOA.

In some embodiments, different users may perceive the source of a sound as coming from slightly different locations. This may be the result of each user having a unique head-related transfer function (HRTF), which may be dictated by a user's anatomy including ear canal length and the positioning of the ear drum. The artificial reality device may provide an alignment and orientation guide, which the user may follow to customize the sound signal presented to the user based on their unique HRTF. In some embodiments, an artificial reality device may implement one or more microphones to listen to sounds within the user's environment. The AR or VR headset may use a variety of different array transfer functions (e.g., any of the DOA algorithms identified above) to estimate the direction of arrival for the sounds. Once the direction of arrival has been determined, the artificial reality device may play back sounds to the user according to the user's unique HRTF. Accordingly, the DOA estimation generated using the array transfer function (ATF) may be used to determine the direction from which the sounds are to be played from. The playback sounds may be further refined based on how that specific user hears sounds according to the HRTF.

In addition to or as an alternative to performing a DOA estimation, an artificial reality device may perform localization based on information received from other types of sensors. These sensors may include cameras, IR sensors, heat sensors, motion sensors, GPS receivers, or in some cases, sensor that detect a user's eye movements. For example, as noted above, an artificial reality device may include an eye tracker or gaze detector that determines where the user is looking. Often, the user's eyes will look at the source of the sound, if only briefly. Such clues provided by the user's eyes may further aid in determining the location of a sound source. Other sensors such as cameras, heat sensors, and IR sensors may also indicate the location of a user, the location of an electronic device, or the location of another sound source. Any or all of the above methods may be used individually or in combination to determine the location of a sound source and may further be used to update the location of a sound source over time.

Some embodiments may implement the determined DOA to generate a more customized output audio signal for the user. For instance, an "acoustic transfer function" may characterize or define how a sound is received from a given location. More specifically, an acoustic transfer function may define the relationship between parameters of a sound at its source location and the parameters by which the sound signal is detected (e.g., detected by a microphone array or detected by a user's ear). An artificial reality device may include one or more acoustic sensors that detect sounds within range of the device. A controller of the artificial reality device may estimate a DOA for the detected sounds (using, e.g., any of the methods identified above) and, based on the parameters of the detected sounds, may generate an acoustic transfer function that is specific to the location of the device. This customized acoustic transfer function may thus be used to generate a spatialized output audio signal where the sound is perceived as coming from a specific location.

Indeed, once the location of the sound source or sources is known, the artificial reality device may re-render (i.e., spatialize) the sound signals to sound as if coming from the direction of that sound source. The artificial reality device may apply filters or other digital signal processing that alter the intensity, spectra, or arrival time of the sound signal. The digital signal processing may be applied in such a way that the sound signal is perceived as originating from the determined location. The artificial reality device may amplify or subdue certain frequencies or change the time that the signal arrives at each ear. In some cases, the artificial reality device may create an acoustic transfer function that is specific to the location of the device and the detected direction of arrival of the sound signal. In some embodiments, the artificial reality device may re-render the source signal in a stereo device or multi-speaker device (e.g., a surround sound device). In such cases, separate and distinct audio signals may be sent to each speaker. Each of these audio signals may be altered according to the user's HRTF and according to measurements of the user's location and the location of the sound source to sound as if they are coming from the determined location of the sound source. Accordingly, in this manner, the artificial reality device (or speakers associated with the device) may re-render an audio signal to sound as if originating from a specific location.

We claim:

1. A system comprising:

at least one audio transducer disposed within a virtual or augmented reality headset; and a controller, wherein:

the controller generates at least one actuation signal;

the at least one actuation signal drives the at least one audio transducer such that the at least one audio transducer generates evanescent wave audio signals in proximity to an ear of a wearer of the headset;

the evanescent wave audio signals decay in strength with lateral distance from the at least one audio transducer; and the decaying of the evanescent wave audio signals increases a level of privacy protection for the wearer of the headset.

2. The system of claim 1, wherein:

the at least one audio transducer comprises a dipole speaker; and a geometry of an enclosure substantially surrounding the dipole speaker generates the evanescent wave audio signals in proximity to the ear of the wearer.

3. The system of claim 1, further comprising:

at least two audio transducers that respectively produce a plurality of actuation signals;

wherein each of the plurality of actuation signals is substantially out of phase in relation to other actuation signals of the plurality of actuation signals.

4. The system of claim 3, wherein each of the plurality of actuation signals is out of phase in relation to other actuation signals of the plurality of actuation signals by less than 180 degrees.

5. The system of claim 3, wherein:

the controller generates a plurality of second actuation signals configured to drive the at least two audio transducers substantially in phase in relation to each other to generate propagating wave audio signals; and generation of the plurality of actuation signals or generation of the plurality of second actuation signals is based on a trigger.

6. The system of claim 5, wherein:

the trigger comprises a signal to noise ratio (SNR), such that the plurality of actuation signals drives the at least two audio transducers when the SNR is below a threshold amount; and the plurality of second actuation signals drives the at least two audio transducers when the SNR is equal to or above the threshold amount.

7. The system of claim 5, further comprising a switch configured to switch between generation of the evanescent wave audio signals and the propagating wave audio signals.

8. The system of claim 7, wherein the switch switches between generation of the evanescent wave audio signals and the propagating wave audio signals by reversing the polarity of either the plurality of actuation signals or the plurality of second actuation signals.

9. The system of claim 1, wherein the controller is configured to beamform an output of the at least one audio transducer in a specified direction.

10. The system of claim 1, wherein:

the system includes a linear array of four or more audio transducers;

a subset of the four or more audio transducers within the linear array is driven by a plurality of actuation signals; and a different subset of the four or more audio transducers within the linear array is driven by a plurality of second actuation signals.

11. The system of claim 1, wherein:

the system further comprises a linear array of audio sources; and generation of the evanescent wave audio signals in proximity to the ear of the wearer is based on at least a spacing distance between the audio sources.

12. The system of claim 11, wherein the audio sources comprise at least one of:

the at least one audio transducer; or openings in an enclosure substantially surrounding the at least one audio transducer.

13. A device comprising:

at least one audio transducer disposed within a virtual or augmented reality headset; and a controller, wherein:

the controller generates at least one actuation signal;

the at least one actuation signal drives the at least one audio transducer such that the at least one audio transducer generates evanescent wave audio signals in proximity to an ear of a wearer of the headset;

the evanescent wave audio signals decay in strength with lateral distance from the at least one audio transducer; and the decaying of the evanescent wave audio signals increases a level of privacy protection for the wearer of the headset.

14. The device of claim 13, wherein:

the at least one audio transducer comprises a dipole speaker; and a geometry of an enclosure substantially surrounding the dipole speaker generates the evanescent wave audio signals in proximity to the ear of the wearer.

15. The device of claim 13, further comprising:

at least two audio transducers producing respectively a plurality of actuation signals;

wherein each of the plurality of actuation signals is substantially out of phase in relation to other actuation signals of the plurality of actuation signals.

16. The device of claim 15, wherein each of the plurality of actuation signals is out of phase in relation to other actuation signals of the plurality of actuation signals by less than 180 degrees.

17. The device of claim 15, wherein:

the controller generates a plurality of second actuation signals configured to drive the at least two audio transducers substantially in phase in relation to each other to generate propagating wave audio signals; and generation of the plurality of actuation signals or generation of the plurality of second actuation signals is based on a trigger.

18. The device of claim 17, wherein:

the trigger comprises a signal to noise ratio (SNR), such that the plurality of actuation signals drives the at least two audio transducers when the SNR is below a threshold amount; and the plurality of second actuation signals drives the at least two audio transducers when the SNR is equal to or above the threshold amount.

19. The device of claim 17, further comprising a switch configured to switch between generation of the evanescent wave audio signals and the propagating wave audio signals.

20. A method comprising:

disposing at least one audio transducer within a wearable device comprising a virtual or augmented reality headset;

providing a controller; and connecting the at least one audio transducer to the controller, wherein:

the controller generates at least one actuation signal;

the at least one actuation signal drives the at least one audio transducer such that the at least one audio transducer generates evanescent wave audio signals in proximity to an ear of a wearer of the headset;

the evanescent wave audio signals decay in strength with lateral distance from the at least one audio transducer; and the decaying of the evanescent wave audio signals increases a level of privacy protection for the wearer of the headset.

* * * * *